US010214914B2

(12) United States Patent
Bachelder

(10) Patent No.: US 10,214,914 B2
(45) Date of Patent: Feb. 26, 2019

(54) FLOORING SYSTEM FOR AND METHODS OF INSTALLING DECKING MATERIAL DIRECTLY ATOP AN INSTALLATION SURFACE

(71) Applicant: Thomas W. Bachelder, Holly Springs, NC (US)

(72) Inventor: Thomas W. Bachelder, Holly Springs, NC (US)

( * ) Notice: Subject to any disclaimer, the term of this patent is extended or adjusted under 35 U.S.C. 154(b) by 0 days.

(21) Appl. No.: 15/378,981

(22) Filed: Dec. 14, 2016

(65) Prior Publication Data

US 2018/0163411 A1 Jun. 14, 2018

(51) Int. Cl.
*E04F 15/02* (2006.01)

(52) U.S. Cl.
CPC .. *E04F 15/02038* (2013.01); *E04F 15/02044* (2013.01); *E04F 15/02161* (2013.01); *E04F 15/02183* (2013.01); *E04F 2015/02111* (2013.01); *E04F 2201/026* (2013.01); *E04F 2201/0505* (2013.01)

(58) Field of Classification Search
CPC ..... E04F 15/02133; E04F 15/02138; E04F 15/02144; E04F 15/0215; E04F 15/02155; E04F 15/02177; E04F 15/02183; E04F 15/02188; E04F 15/10; E04F 15/102; E04F 15/105; E04F 15/107; E04F 15/042; E04F 15/085; E04F 15/087; E04F 15/00; E04F 15/02; E04F 15/02005; E04F 15/02011; E04F 15/02022; E04F 15/02027; E04F 15/02033; E04F 15/02038; E04F 15/02044; E04F 2015/02066; E04F 2015/02072; E04F 2015/02077; E04F 2015/02094
See application file for complete search history.

(56) References Cited

U.S. PATENT DOCUMENTS 3,802,144 A * 4/1974 Spica ..... E01C 11/225 404/36
4,462,712 A * 7/1984 Penland, Sr. ..... E01C 9/086 404/36
5,032,037 A * 7/1991 Phillips ..... E01C 9/086 404/35
7,210,211 B2 * 5/2007 Harrison ..... B23B 39/161 29/26 A
8,826,609 B1 * 9/2014 Chang ..... E04F 15/02161 52/177

(Continued)

*Primary Examiner* — Jessica L Laux
(74) *Attorney, Agent, or Firm* — Ward and Smith, P.A.; Ryan K. Simmons

(57) ABSTRACT

A flooring system that may include one or more floor members, wherein the one or more floor members may be configured together to form a floor covering atop an installation surface, which may be a non-dry environment, and wherein one or more of the one or more floor members are secured directly to the installation surface, and wherein the one or more floor members is made of a non-wood decking material. The one or more floor members may include one or more holding floor members, and one or more floating floor members, wherein the one or more holding floor members engage with one or more of the one or more floating floor members to form the floor covering atop the installation surface, and wherein the holding floor members are configured and arranged to secure the floor covering in place atop the installation surface.

20 Claims, 42 Drawing Sheets

(56) References Cited

U.S. PATENT DOCUMENTS

| | | | | |
|---|---|---|---|---|
| 9,038,324 | B2 * | 5/2015 | Kugler | E04F 15/02464 52/126.6 |
| 10,011,998 | B1 * | 7/2018 | Dantzer | E04F 15/02183 |
| 2003/0154662 | A1 * | 8/2003 | Bruchu | E04F 15/10 52/87 |
| 2004/0079041 | A1 * | 4/2004 | Bergeron | E04F 15/10 52/489.1 |
| 2005/0204662 | A1 * | 9/2005 | Showers | E04F 15/10 52/263 |
| 2005/0210809 | A1 * | 9/2005 | Nevison | E04F 15/105 52/578 |
| 2005/0252109 | A1 * | 11/2005 | Fuccella | E04F 15/02172 52/177 |
| 2008/0209839 | A1 * | 9/2008 | Amato | E04F 19/061 52/588.1 |
| 2009/0266022 | A1 * | 10/2009 | Lin | E04F 15/10 52/506.1 |
| 2014/0260041 | A1 * | 9/2014 | Peck | F16B 5/0685 52/489.1 |
| 2016/0237673 | A1 * | 8/2016 | Rempert | E04B 1/003 |

* cited by examiner

FLOORING SYSTEM FOR AND METHODS OF INSTALLING DECKING MATERIAL DIRECTLY ATOP AN INSTALLATION SURFACE

TECHNICAL FIELD

The presently disclosed subject matter relates generally to flooring systems and more particularly to a flooring system for and methods of installing decking material directly atop an installation surface, such as concrete.

BACKGROUND

Home porches and patios often have concrete floors. However, concrete floors can have certain drawbacks. For example, the appearance of concrete floors is often not aesthetically pleasing. Further, for some people, the feeling of walking or, for example, using a rocking chair on a hard concrete surface is not desirable. Because it is difficult to install fasteners into concrete, sleeper systems have been used for installing, for example, a wooden floor atop a concrete surface. However, many home porches and patios do not have enough vertical clearance to allow the installation of a sleeper system. Further, sleeper systems for wooden flooring are not suitable for non-dry environments.

SUMMARY

In one embodiment, the invention provides a flooring system. The flooring system may include one or more floor members, wherein the one or more floor members are configured together to form a floor covering atop an installation surface, and wherein one or more of the one or more floor members are secured directly to the installation surface; and wherein the one or more floor members includes a non-wood decking material. The installation surface may be a non-dry environment. The one or more floor members may include one or more holding floor members; and one or more floating floor members, wherein the one or more holding floor members engage with one or more of the one or more floating floor members to form the floor covering atop the installation surface, and wherein the holding floor members may be configured and arranged to secure the floor covering in place atop the installation surface. The holding floor members may be directly secured to the installation surface. The one or more of the one or more holding floor members and one or more of the one or more floating floor members may be directly secured to the installation surface. The one or more of the one or more holding floor members may engage with one or more of the one or more floating floor members in an interlocking fashion. The installation surface may be an existing flooring surface. The installation surface may be any one or more of a concrete surface, stone surface, tile surface, and/or brick surface. The the non-wood decking material may include at least one of composite decking material and poly(vinyl chloride) (PVC) decking material. The one or more of the one or more floor members may be secured to the installation surface using at least one of an adhesive and mechanical fastener. The mechanical fastener may be at least one of a screw, bolt, and nail. The one or more of the one or more holding floor members may include a notch formed on at least one underside side edge of the holding floor member, and wherein the notch may span substantially an entire length of the underside side edge. The one or more of the one or more floating floor members may include a notch formed on a upper side of at least one end of the floating floor member, and wherein the notch may span substantially an entire width of the at least one end. The one or more of the one or more holding floor members may include a notch formed on at least one underside side edge of the holding floor member, wherein the notch may span substantially an entire length of the underside side edge; and wherein one or more of the one or more floating floor members may include a notch formed on a upper side of at least one end of the floating floor member, wherein the notch may span substantially an entire width of the at least one end. The notch of the one or more floating floor members may be configured to interlock with the notch of the one or more holding floor members. The plurality of floating floor members may be secured in place atop the installation surface by a lessor number of holding floor members. The flooring system may further include a buffer layer disposed between the floor covering and the installation surface. The one or more of the one or more floor members may include one or more drainage channels along an underside thereof. The one or more of the one or more floor members may include a ramp feature or step transition feature on an upper surface thereof. The flooring system may further include a ramp strip. The flooring system may further include a holding strip, wherein the holding strip may be secured to at least one of the installation surface and an adjacent structure. The portion of the flooring system where the one or more holding floor members engage with one or more of the one or more floating floor members may be substantially hidden from view.

In another embodiment, the invention provides a method of installing the flooring system atop an installation surface. The method may include providing a flooring system that may include one or more floor members, wherein the one or more floor members are configurable to form a floor covering atop the installation surface, and wherein the one or more floor members are made of non-wood decking material; arranging the floor members on the installation surface to group the one or more floor members to form the floor covering configuration; and securing one or more of the one or more floor members directly to the installation surface, such that the floor covering is secured in place atop the installation surface. The one or more floor members may include one or more holding floor members; and one or more floating floor members, wherein the one or more holding floor members engage with one or more of the one or more floating floor members to form the floor covering atop the installation surface, and wherein the holding floor members are configured and arranged to secure the floor covering in place atop the installation surface. The flooring system may include a clearance height that is substantial equal to the thickness of the one or more floor members. The installation surface comprises a non-dry environment.

BRIEF DESCRIPTION OF THE DRAWINGS

Figure 1:
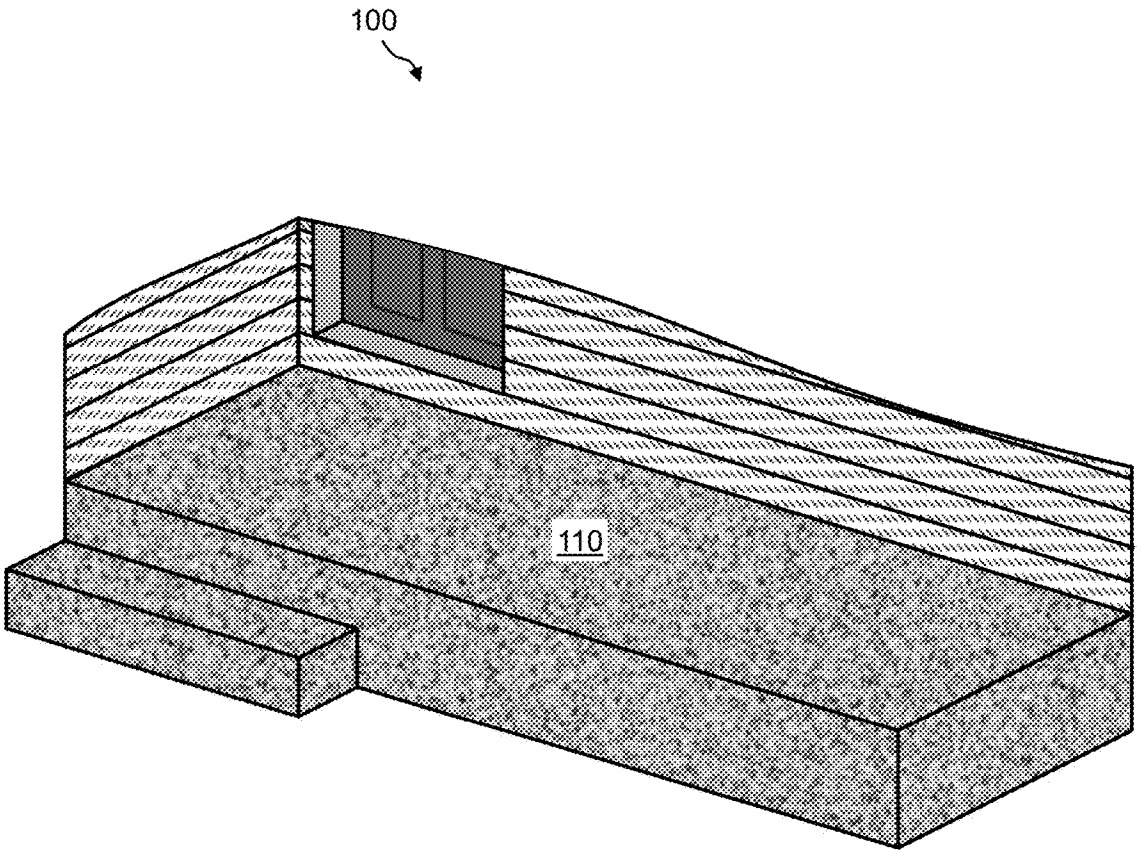
FIG. 1 (PRIOR ART)
Figure 2:
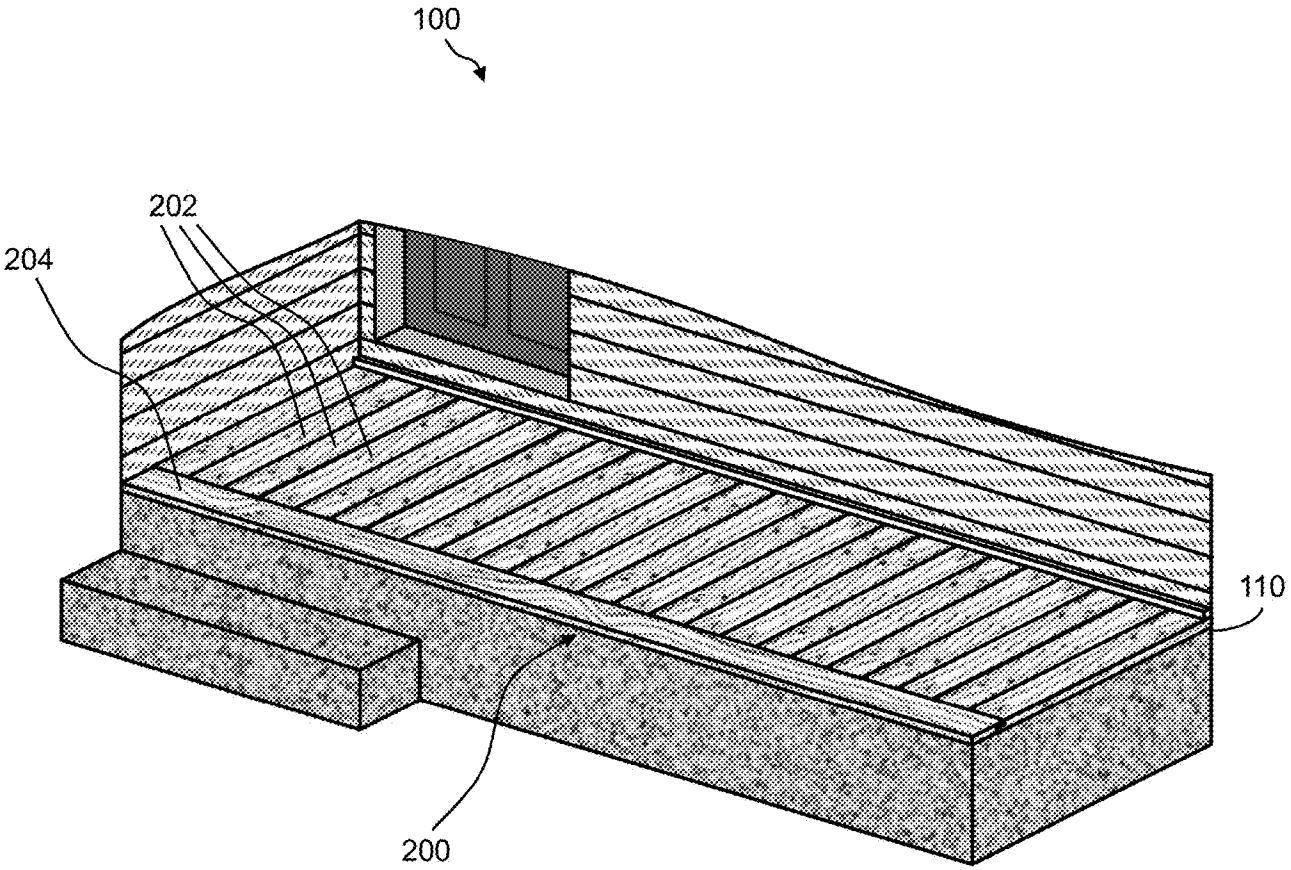
Figure 3:
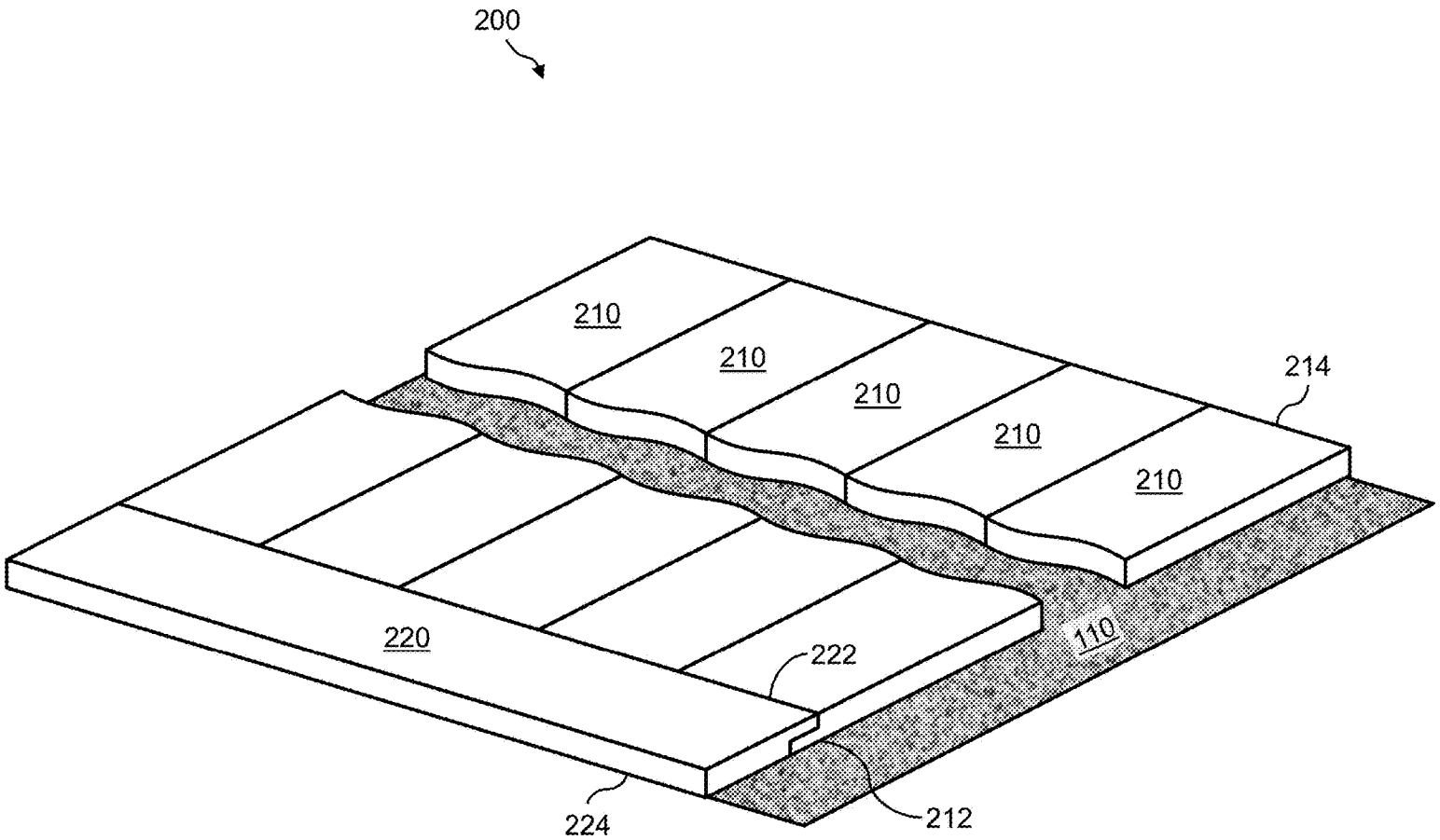
Figure 4:
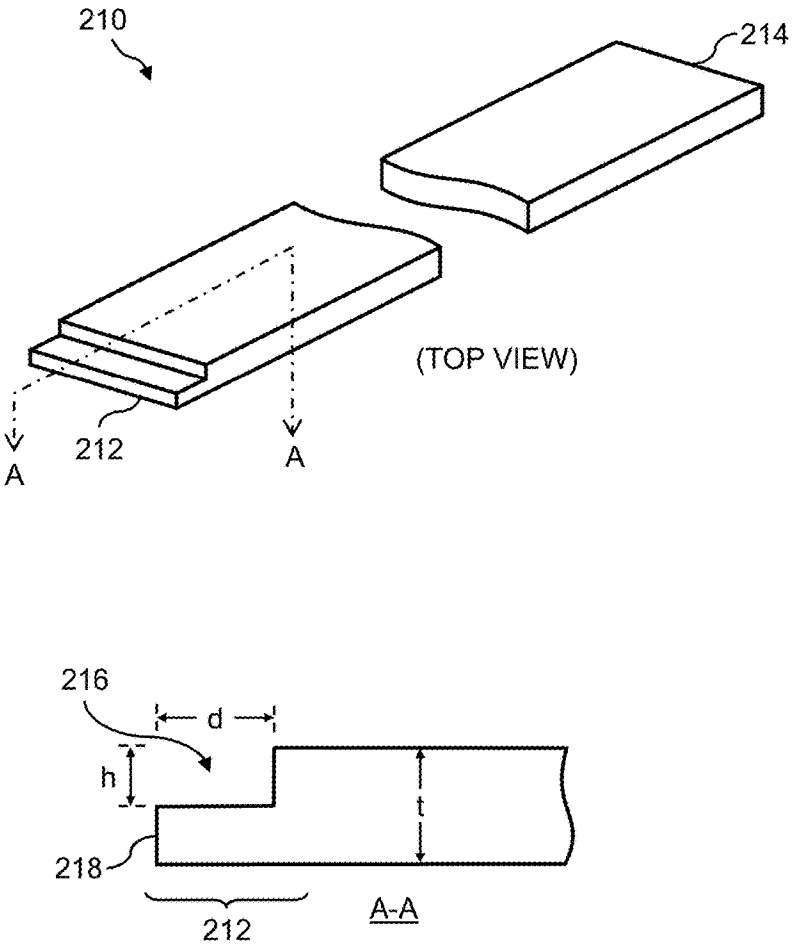
Figure 5:
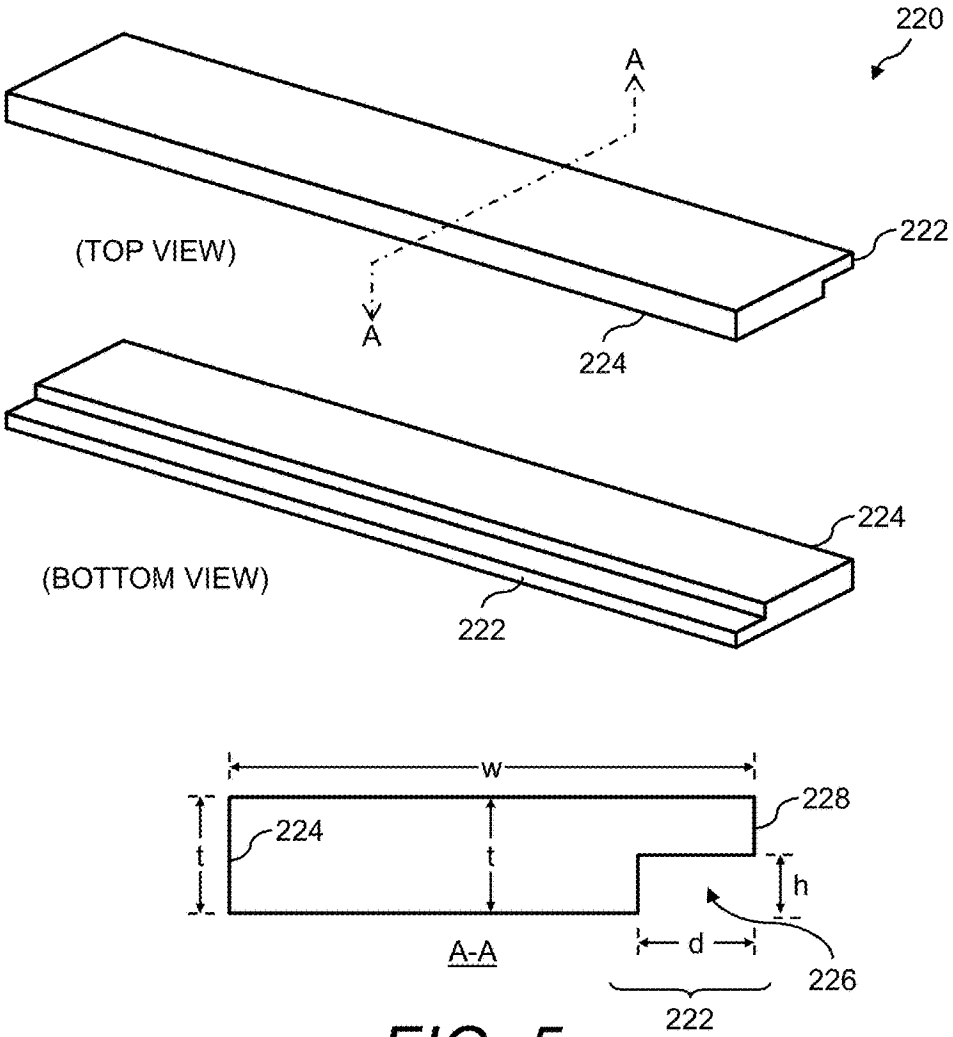
Figure 6:
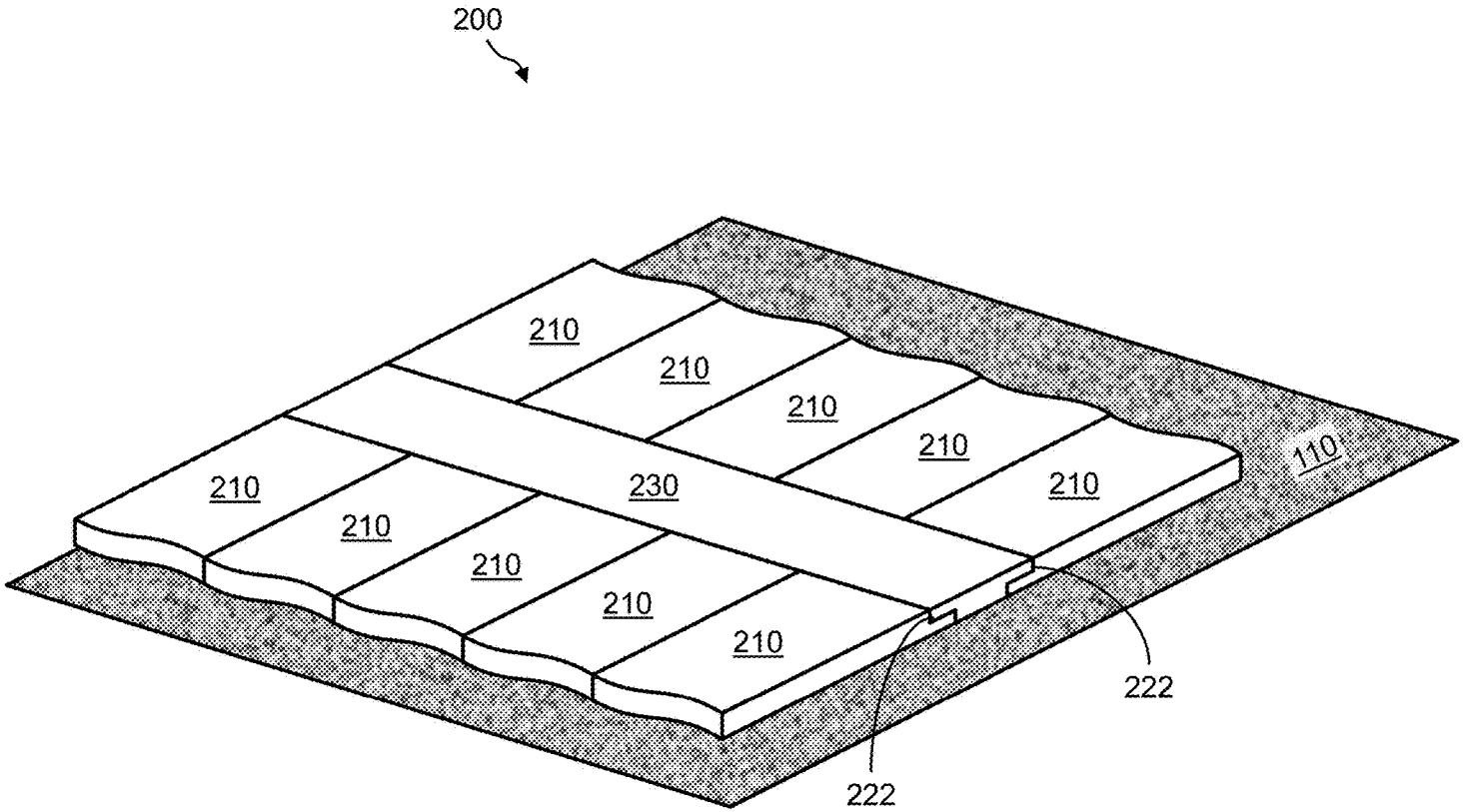
Figure 7:
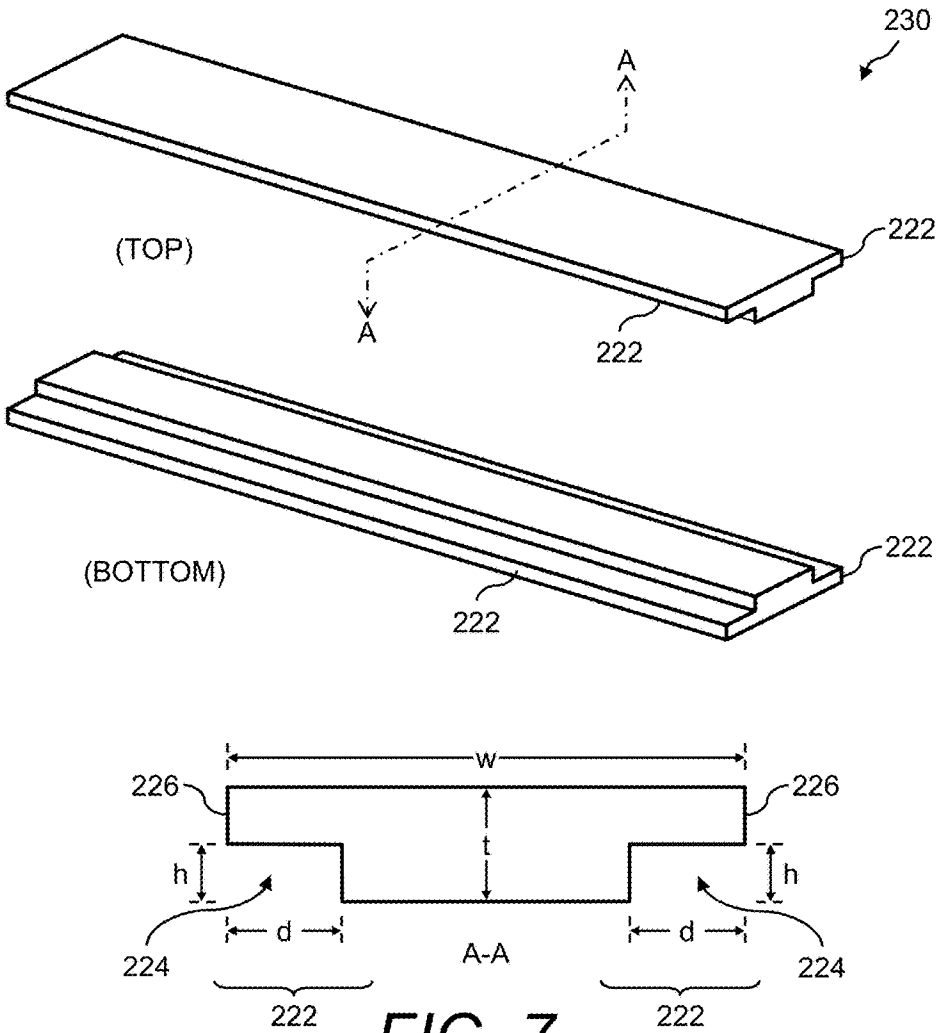
Figure 8:
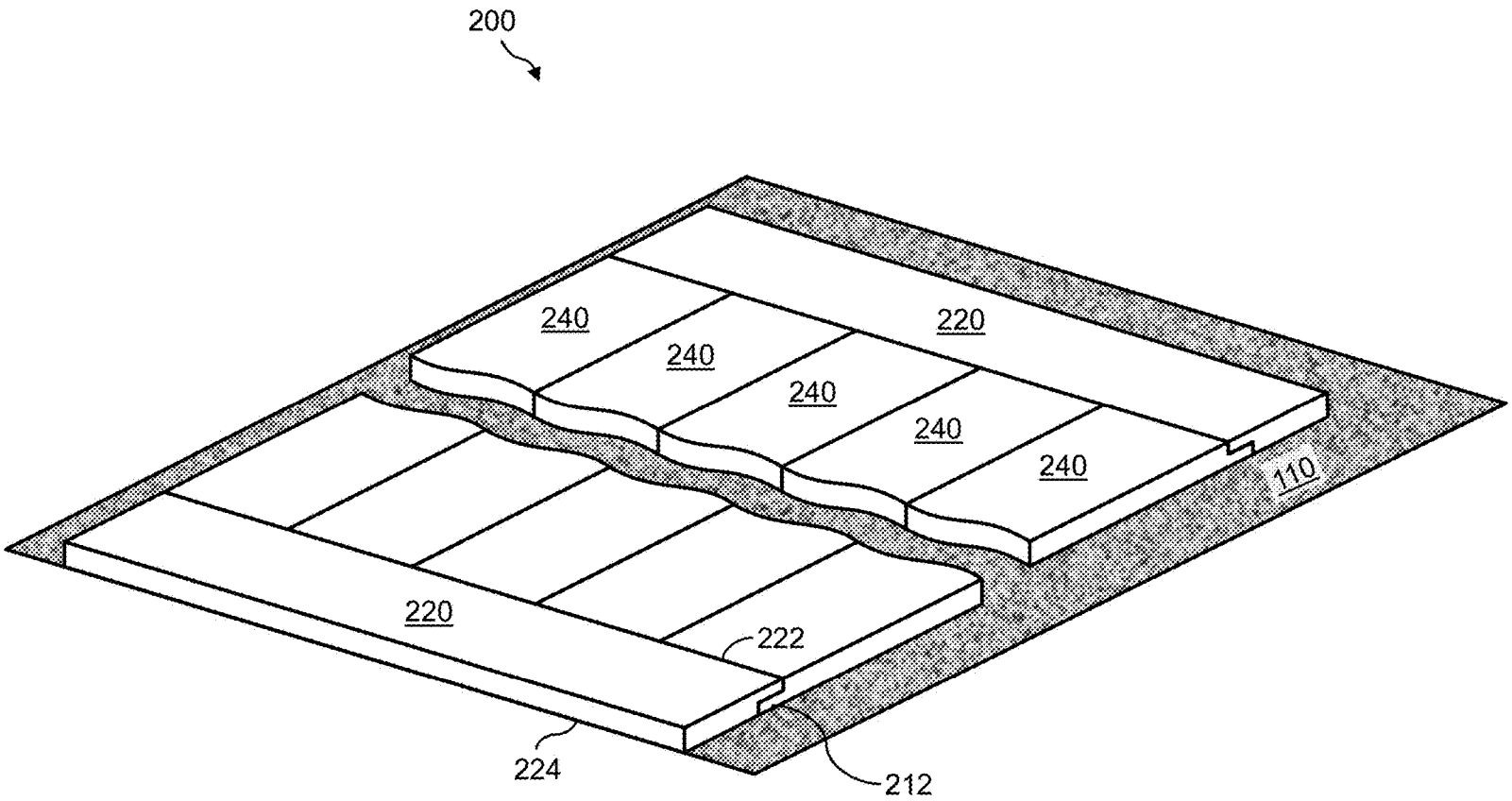
Figure 9:
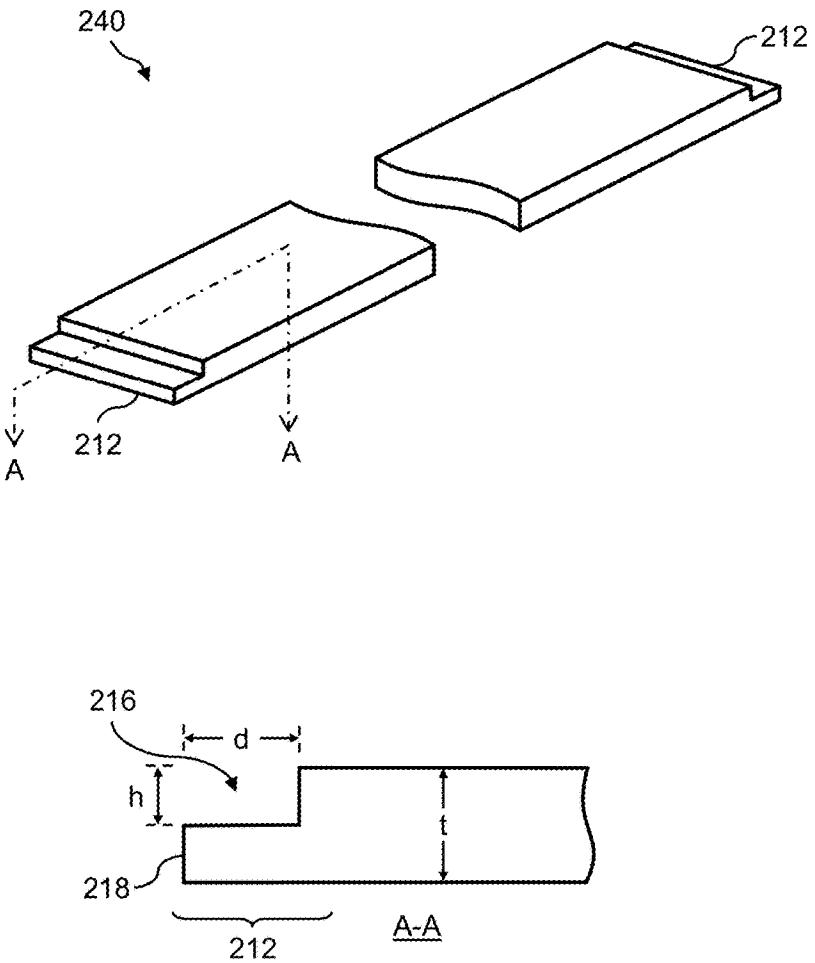
Figure 10A:
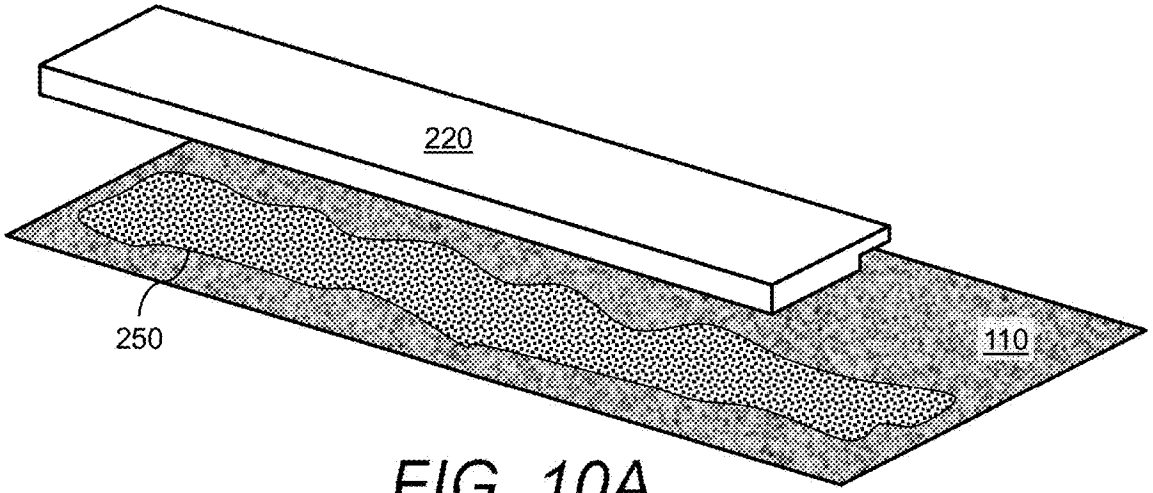
Figure 10B:
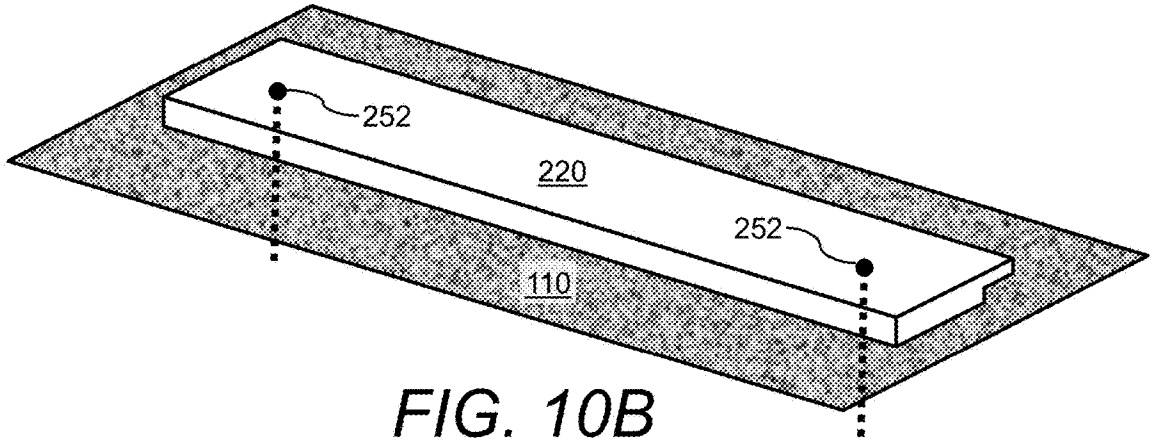
Figure 22:
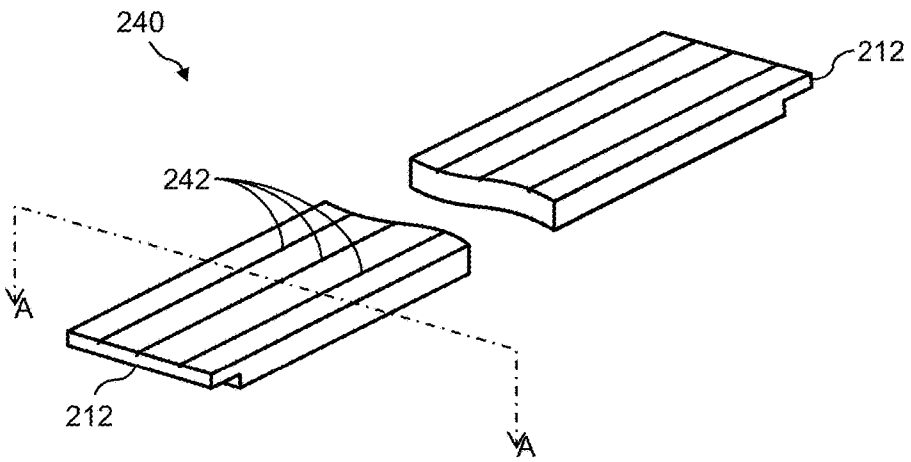
Figure 22:
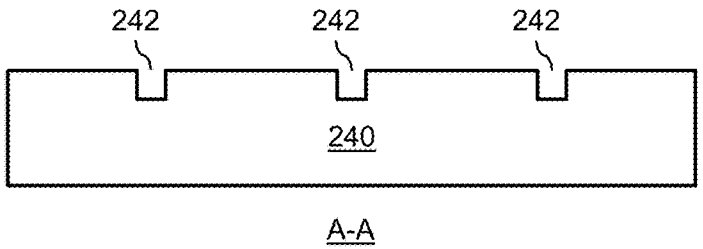
Figure 23A:
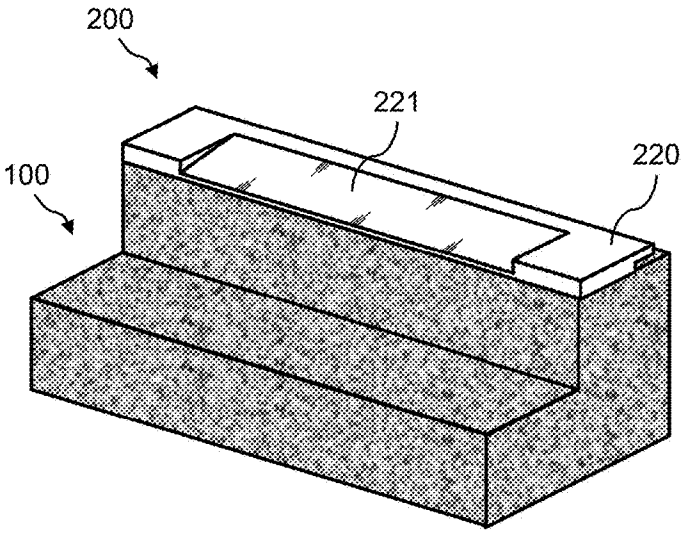
Figure 23B:
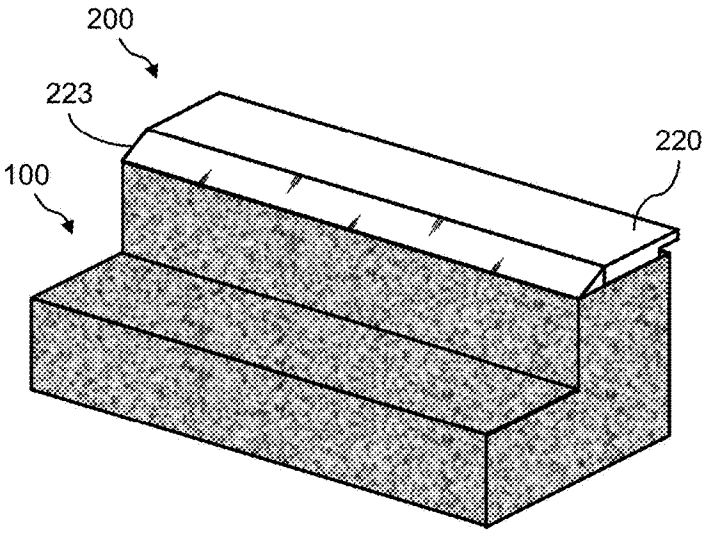
Figure 24:
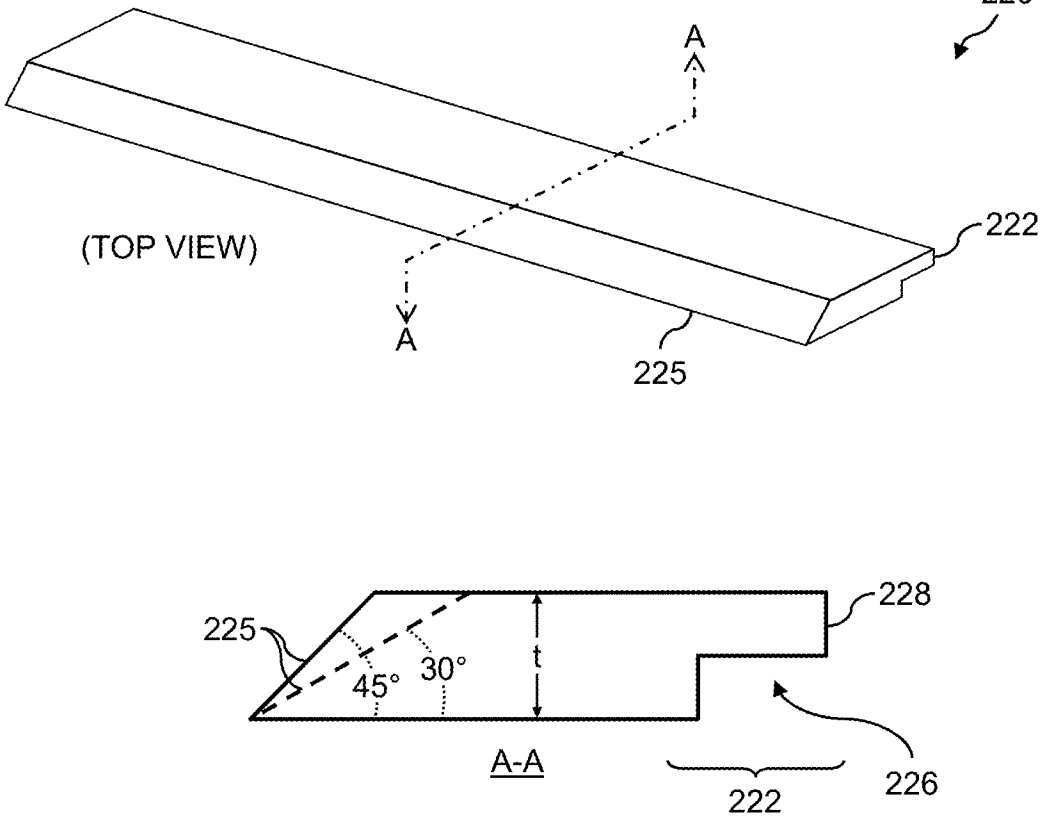
Figure 25:
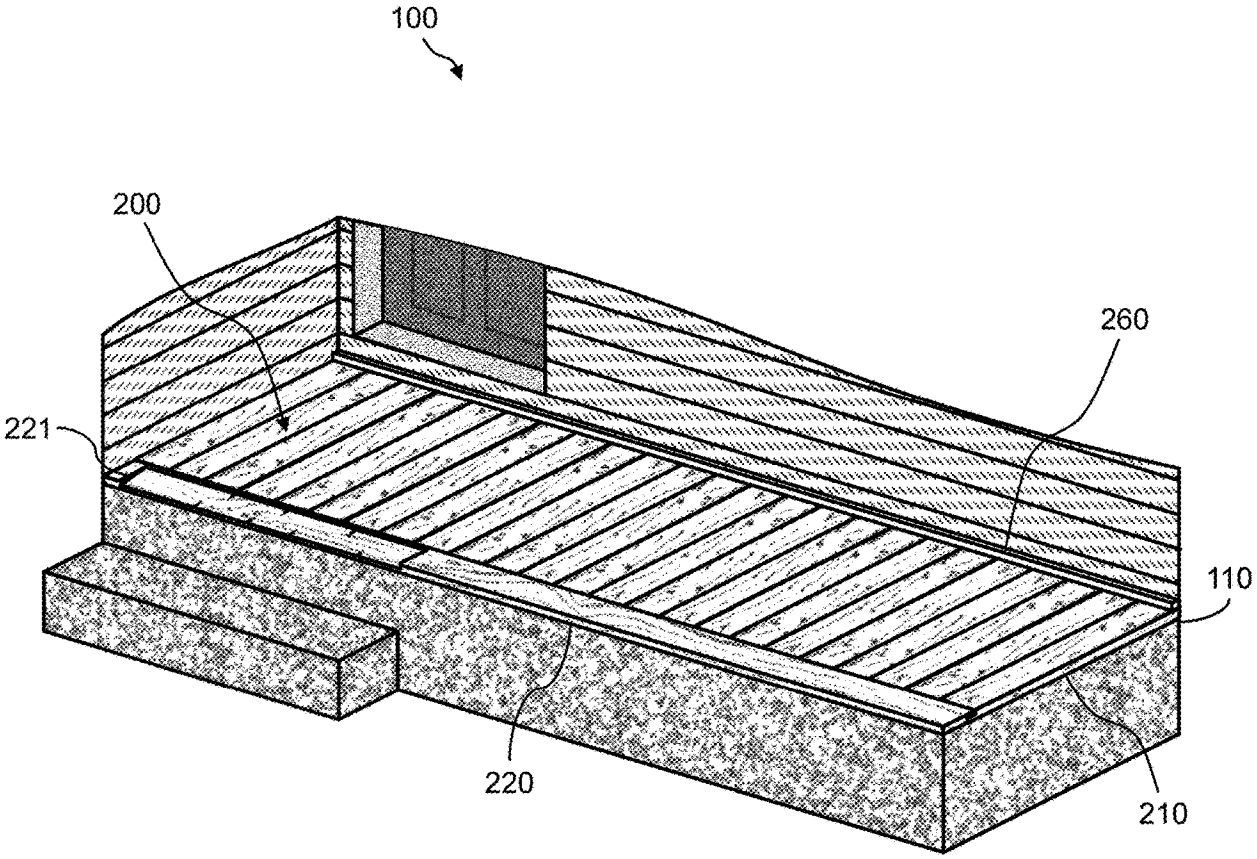
Figure 26:
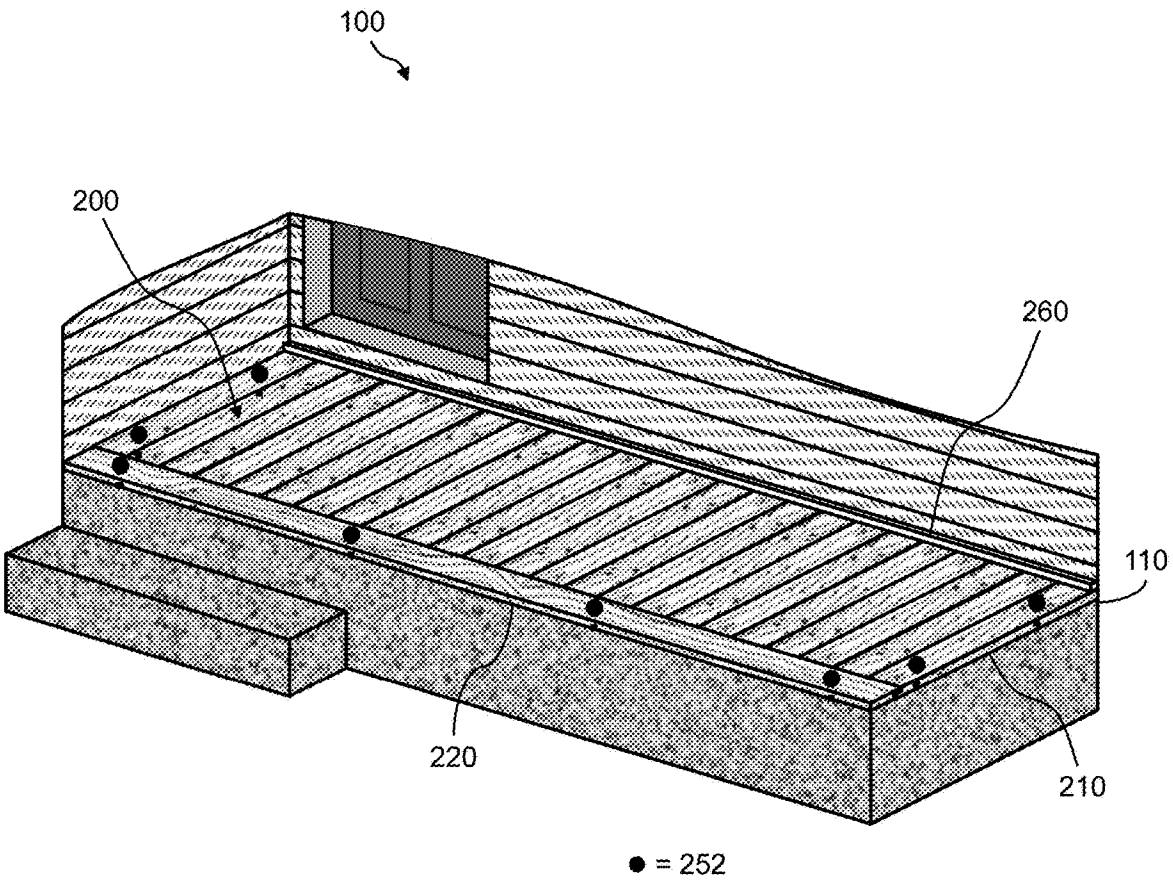
Figure 27:
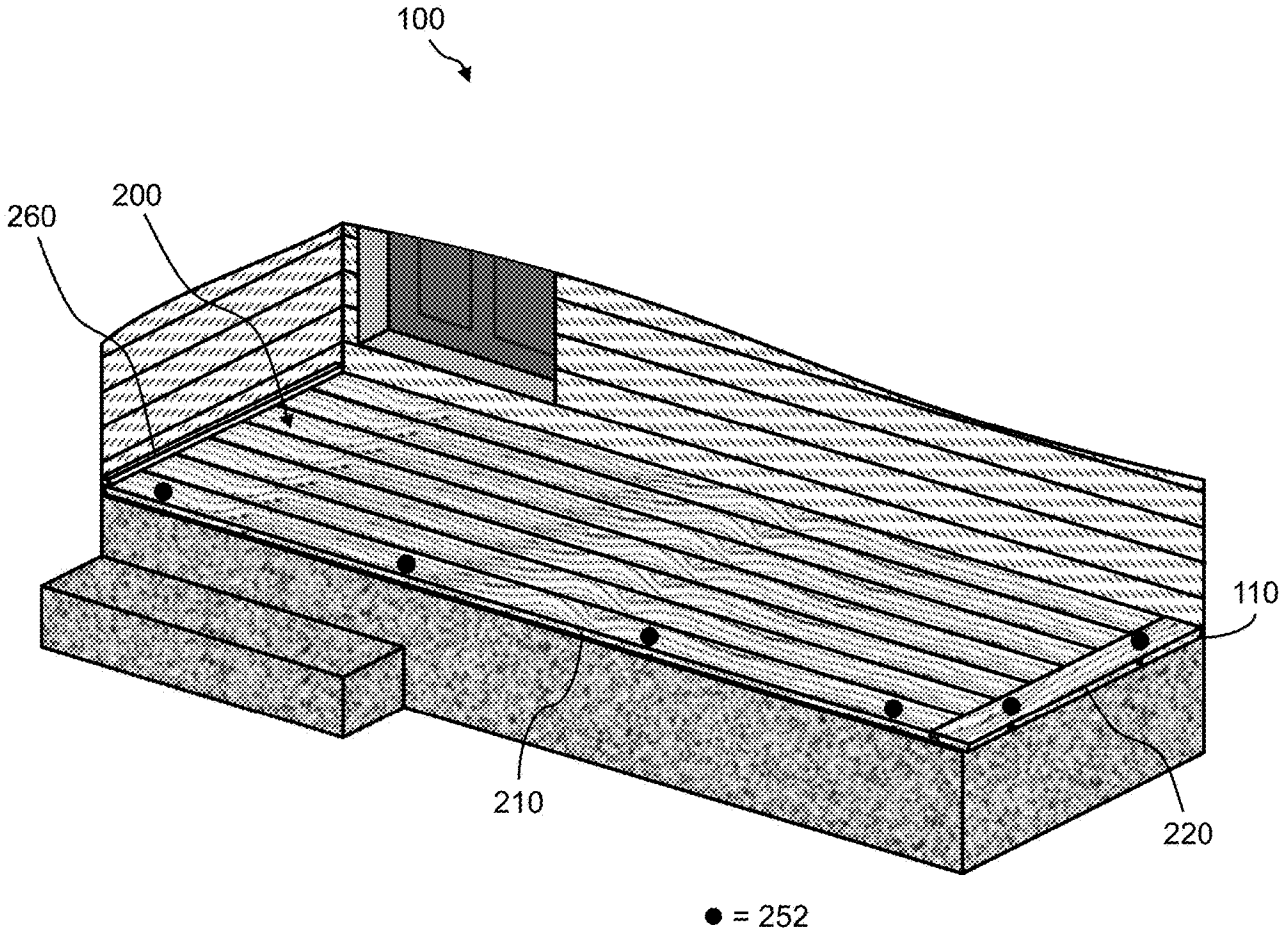
Figure 28:
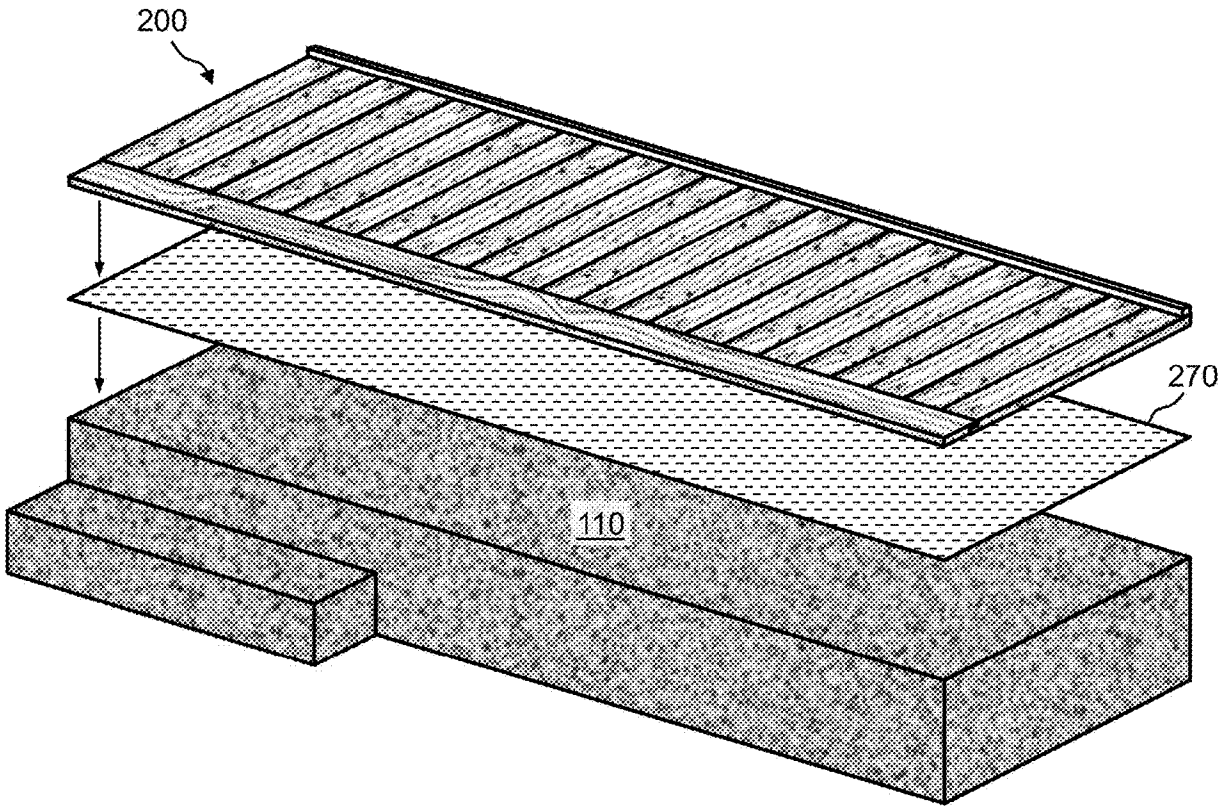
Figure 29:
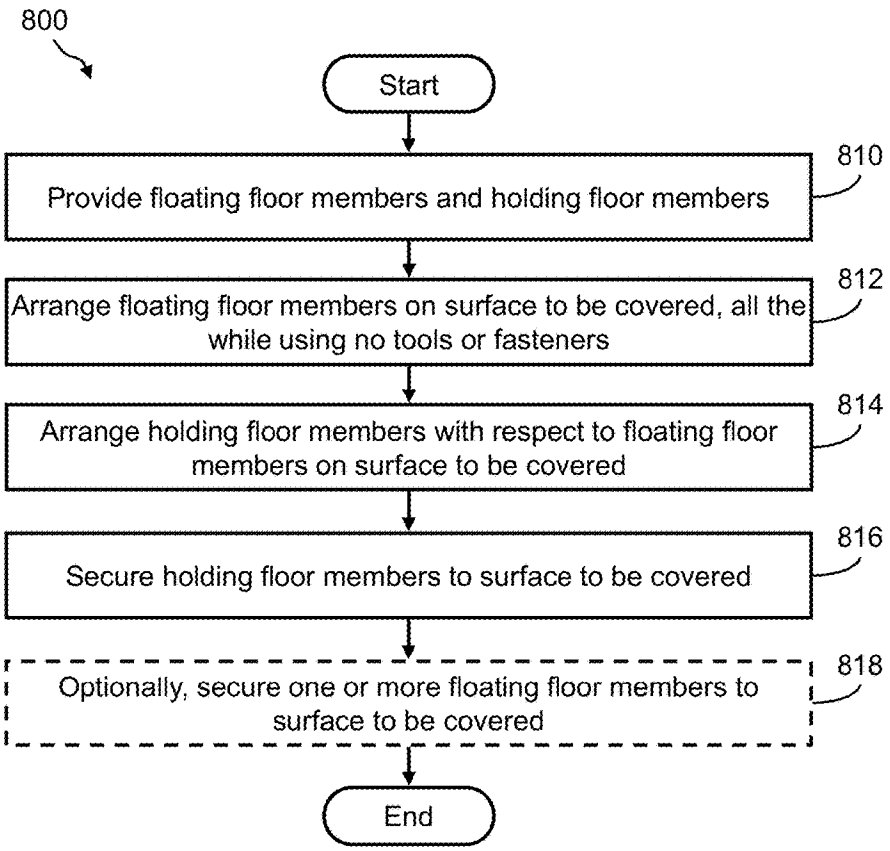
Figure 30:
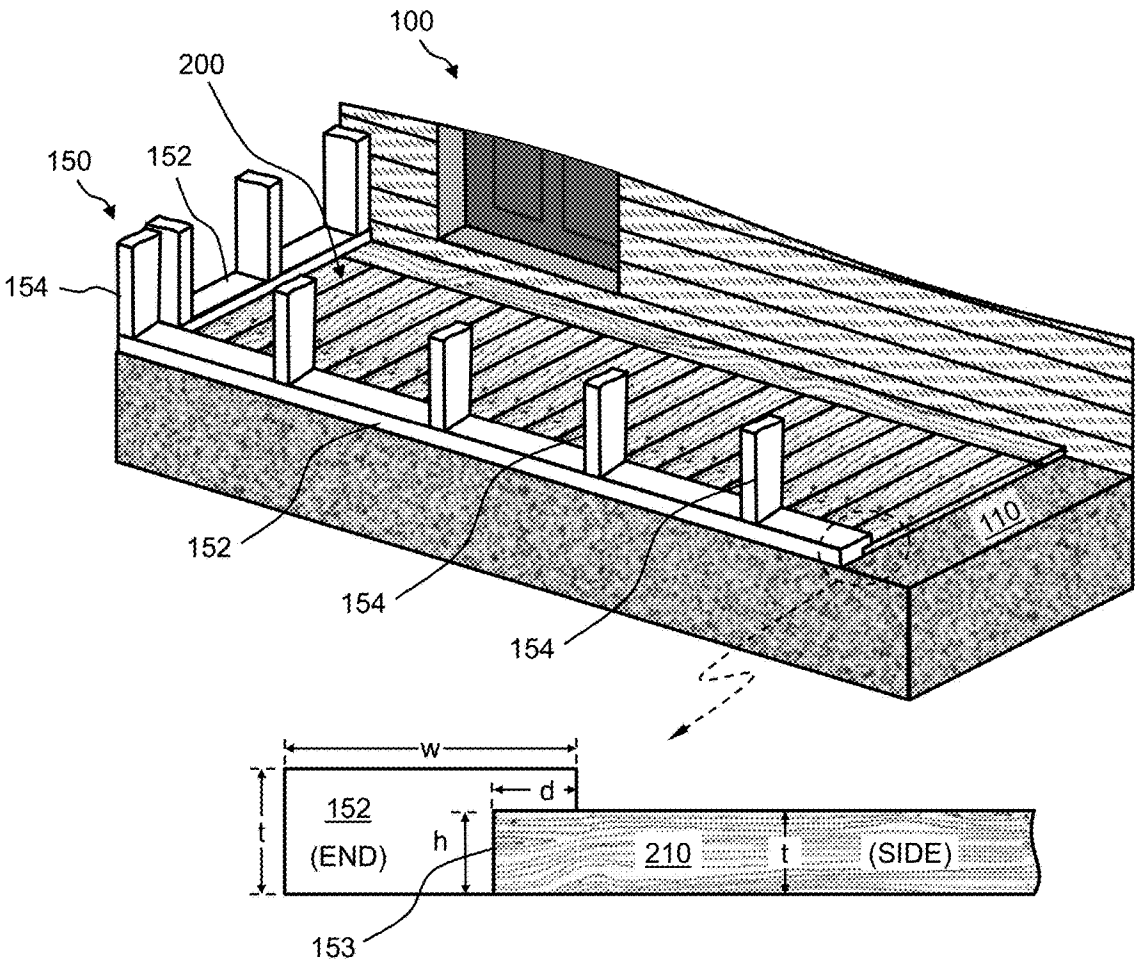
Figure 31:
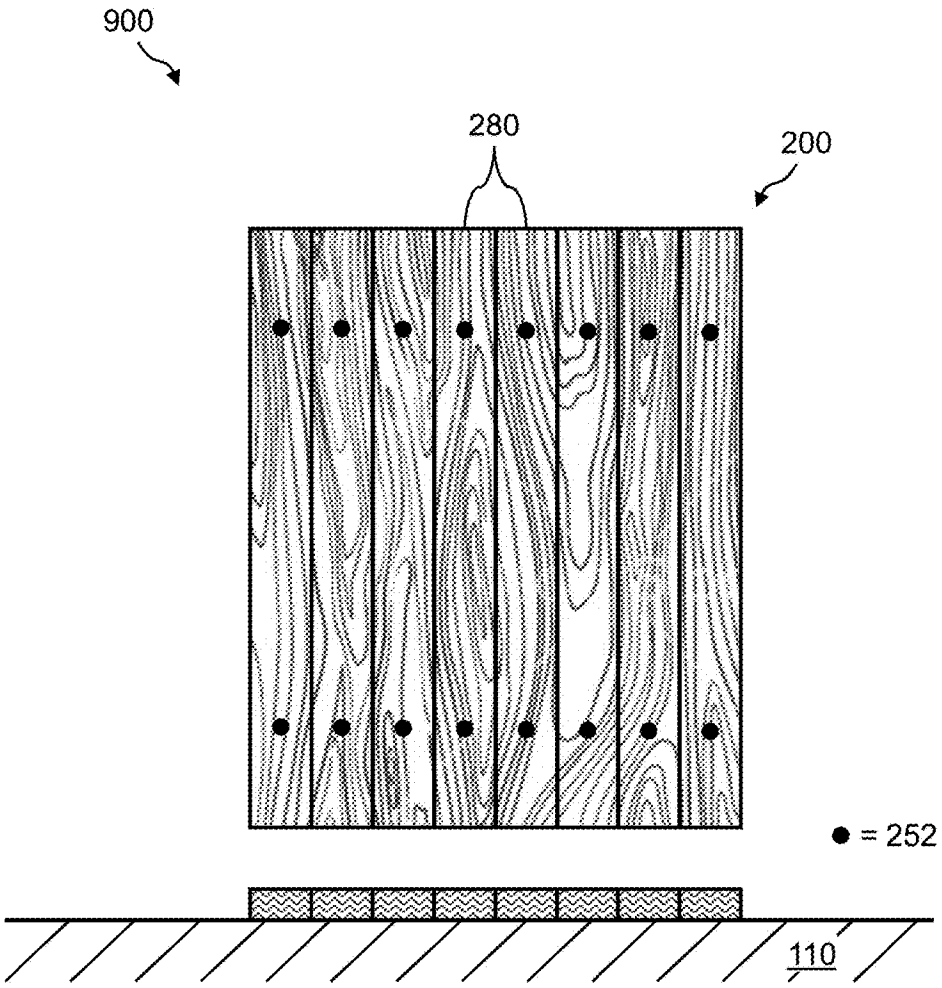
Figure 32:
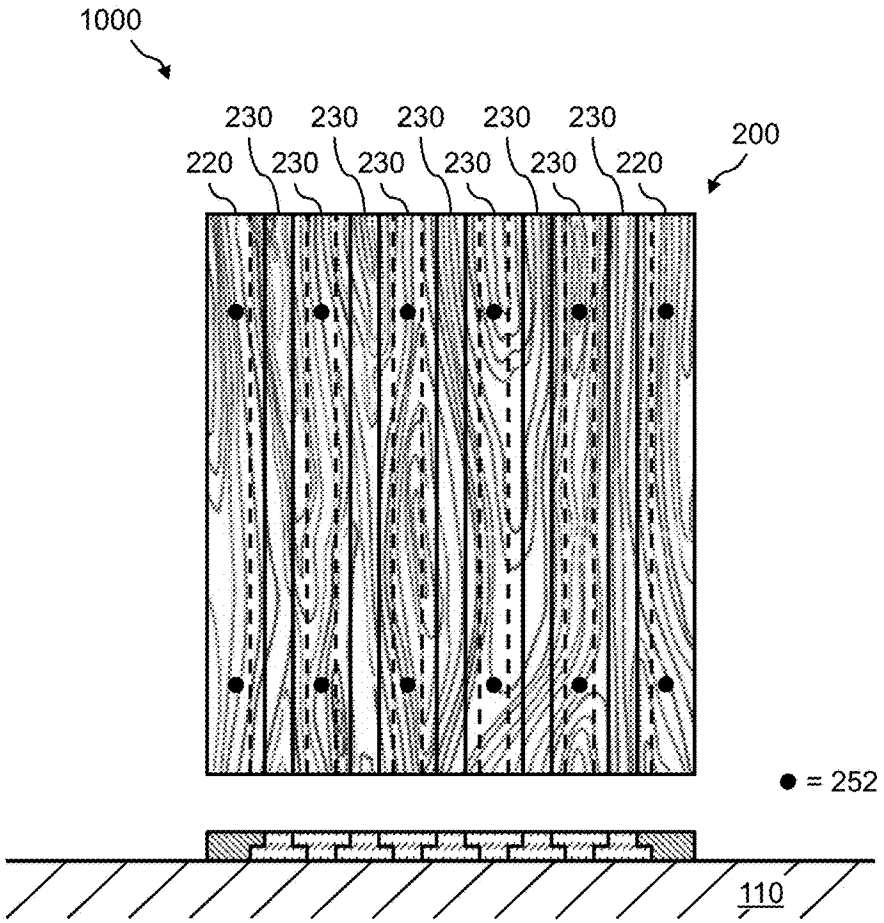
Figure 33:
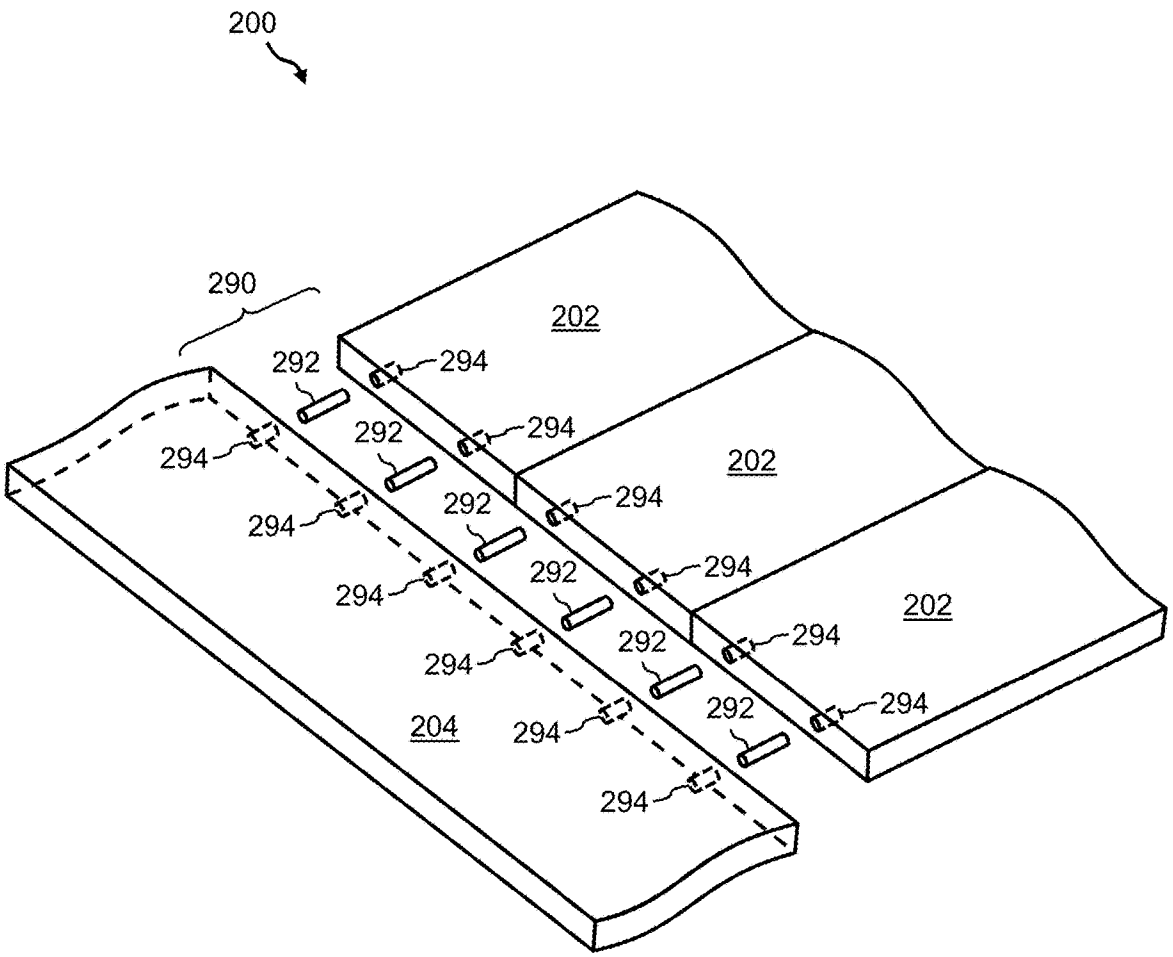

Having thus described the presently disclosed subject matter in general terms, reference will now be made to the accompanying Drawings, which are not necessarily drawn to scale, and wherein:

FIG. 1 illustrates a perspective view of an example of a standard porch structure that has a concrete floor;

FIG. 2 illustrates a perspective view of the presently disclosed flooring system for installing decking material directly atop a concrete surface of the standard porch structure;

FIG. 3 illustrates a perspective view of an example of the presently disclosed flooring system that includes examples of floating floor members and holding floor members;

FIG. 4 illustrates a perspective view and a cross-sectional view of an example of the one-end-notched floor member;

FIG. 5 illustrates perspective views and a cross-sectional view of an example of the one-side-notched holding member;

FIG. 6 illustrates a perspective view of another example of the presently disclosed flooring system that includes other examples of floating floor members and holding floor members;

FIG. 7 illustrates perspective views and a cross-sectional view of an example of the two-side-notched holding member;

FIG. 8 illustrates a perspective view of another example of the presently disclosed flooring system that includes yet other examples of floating floor members and holding floor members;

FIG. 9 illustrates a perspective view and a cross-sectional view of an example of the two-end-notched floor member;

FIG. 10A and FIG. 10B show example methods of securing the holding floor members to a concrete surface;

FIG. 11 through FIG. 16 show an example of a process of installing the presently disclosed flooring system directly atop a concrete surface while using minimal fasteners;

FIG. 17A through FIG. 21C show examples of different configurations of the presently disclosed flooring system installed directly atop a concrete surface while using minimal fasteners;

FIG. 22 illustrates a perspective view and a cross-sectional view of the two-end-notched floor member that includes drainage channels along the underside thereof;

FIG. 23A and FIG. 23B illustrate perspective views of examples of step transition features of the presently disclosed flooring system;

FIG. 24 illustrates a perspective view and a cross-sectional view of an example of the one-side-notched holding member that has a beveled edge;

FIG. 25 illustrates a perspective view of the presently disclosed flooring system atop the concrete surface of the standard porch structure and including the step transition feature;

FIG. 26 and FIG. 27 illustrate example configurations of the presently disclosed flooring system atop the concrete surface of the standard porch structure and including a minimal amount of fastening;

FIG. 28 illustrates an exploded view of the presently disclosed flooring system that further includes a buffer layer;

FIG. 29 illustrates a flow diagram of an example of a method of installing the presently disclosed flooring system directly atop a concrete surface according to a simplest configuration;

FIG. 30 illustrates a perspective view of the presently disclosed flooring system in combination with other standard construction members;

FIG. 31 and FIG. 32 show yet other configurations of the presently disclosed flooring system installed directly atop a concrete surface while using minimal fasteners; and FIG. 33 illustrates an example of the presently disclosed flooring system that includes peg and hole joints for coupling the floating floor members to the holding floor members.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a flooring system for and methods of installing decking material directly atop a concrete surface.

The presently disclosed flooring system includes an arrangement of floor members formed of long lasting, non-wood decking material, such as, but not limited to, composite decking, cellular poly(vinyl chloride) (PVC) decking, and the like. Namely, the floor members can be formed of any material that does not substantially degrade by prolonged (i.e., years of) direct contact with a concrete surface and in non-dry environments, such as any exterior environments and in basements.

In the presently disclosed flooring system, the floor members are laid directly atop the concrete surface, wherein the majority of floor members are left floating (hereafter called floating floor members) and held by a small number of floor members that are fastened to the concrete surface (hereafter called holding floor members). Further, both the floating floor members and the holding floor members include features, such as notches, that allow the floating floor members to interlock with the holding floor members. Additionally, the floating floor members greatly outnumber the holding floor members and because preferably only the holding floor members require fastening, the amount of mechanical fasteners required in the presently disclosed flooring system is greatly reduced compared to conventional flooring/decking systems. Accordingly, the presently disclosed flooring system provides an easy way to install and secure decking material directly atop a concrete surface, or any type of surface, such as, but not limited to, stone surfaces, tile surfaces, brick surfaces, composite surfaces, wood surfaces, and any combinations thereof.

For example, to install the flooring portion of a conventional wooden floor system, such as on a deck, a 12-ft×12-ft area requires, for example, 24 6-inch wide floor boards. If nailed or screwed every 16 inches, the entire installation would require 480 nails or screws (20 per board). By contrast, the same configuration using the presently disclosed flooring system includes 22 floating floor members (that require no mechanical fastening) interlocked with 4 holding floor members only, wherein each of the 4 holding floor members can require as few as 2 mechanical fasteners only, for a total of 8 mechanical fasteners for the entire installation. In this example, 8 concrete fasteners is very feasible for the entire 12-ft×12-ft installation, wherein using 480 concrete fasteners would be very difficult and not feasible. Namely, in this example, there is about a 98% reduction in the number of mechanical fasteners compared to conventional floor systems.

An aspect of the presently disclosed flooring system and methods is that it provides an easily installed, long lasting, moisture-tolerant, aesthetically pleasing, and pleasant feeling floor covering for any concrete surface, such as for a concrete porch floor, concrete patio floor, concrete basement floor, and concrete floor of any building. Namely, the presently disclosed flooring system and methods can be used to easily provide the look and feel of wood to a concrete surface.

Another aspect of the presently disclosed flooring system and methods is that it is suitable for use atop concrete in any non-dry environments, such as in any exterior environments and in basements.

Yet another aspect of the presently disclosed flooring system and methods is that it requires about one inch only (i.e., the thickness of the floor members) of vertical clearance atop the concrete surface, as compared with the several inches (which is very limiting) that is needed to install a conventional sleeper system.

Still another aspect of the presently disclosed flooring system and methods is that it is not limited to use atop concrete surfaces only. The presently disclosed flooring system can be used atop any type of surface, such as, but not limited to, concrete surfaces, stone surfaces, tile surfaces, brick surfaces, composite surfaces, wood surfaces, and any combinations thereof.

In the presently disclosed flooring system, "holding floor member" means any floor member that is directly secured to the concrete surface by, for example, adhesive; any type of screw, bolt, or nail for securing to concrete; or any other type of mechanical fastener for securing to concrete. Namely, the holding floor member is secured independently with no reliance on adjacent members and/or structures.

In the presently disclosed flooring system, "floating floor member" means any floor member that is not directly secured to the concrete surface by, for example, adhesive; any type of screw, bolt, or nail for securing to concrete; or any other type of mechanical fastener for securing to concrete. Rather, a floating floor member is held by gravity atop the concrete surface and held in place by interlocking with one or more adjacent floor members and/or by abutting any other structure or member. Further, a floor member may begin as a "floating floor member" and then can become a "holding floor member" if directly secured to the concrete surface at a later time.

Referring now to FIG. 1 is a perspective view of an example of a standard porch structure 100 that has a concrete floor. Namely, the standard porch structure 100 is representative of any type of standard porch structure that includes a poured concrete floor, such as a concrete floor 110. The concrete floor 110 is an example of a floor that is not aesthetically pleasing to look. Further, for some people, the feeling of walking or using a rocking chair on the concrete floor 110 may not be not desirable.

Referring now to FIG. 2 is a perspective view of an example embodiment of the presently disclosed flooring system 200 for installing decking material directly atop a concrete surface of the standard porch structure 100. Installing the presently disclosed flooring system 200 directly atop the concrete floor 110 can reduce or substantially eliminate the undesirable characteristics of the concrete floor 110. Namely, the presently disclosed flooring system 200 can render the concrete floor 110 of the standard porch structure 100 aesthetically pleasing to the eye and pleasantly feeling to walk. Concrete surfaces may be improved by painting, staining, or applying any other decorative coating, or by installing tile thereon. However, neither coatings nor tile can provide the look and feel of wood. Accordingly, the presently disclosed flooring system 200 can provide the look and feel of wood, or wood like material to a concrete surface.

Whereas concrete can be difficult to attach a floor covering to, the presently disclosed flooring system 200 requires minimal attachment points for easy installation thereof. Namely, in the presently disclosed flooring system 200, the floor members are laid directly atop the concrete surface, wherein the majority of the floor members are left floating (hereafter called floating floor members 202) and held by a small number of floor members that are fastened to the concrete surface (hereafter called holding floor members 204). Namely, both the floating floor members 202 and the holding floor members 204 include features, such as notches, grooves, or the like, that allow the floating floor members 202 to interlock/engage with the holding floor members 204. Additionally, the floating floor members 202 greatly outnumber the holding floor members 204. Because, preferably, only the holding floor members 204 require fastening, the amount of mechanical fasteners required in the presently disclosed flooring system 200 is very minimal compared to conventional flooring/decking systems. Accordingly, a main advantage of flooring system 200 is that the floating floor members 202 simply lay by gravity atop the concrete floor 110 and are held in place by interlocking with the holding floor members 204. In so doing, the presently disclosed flooring system 200 provides an easy way to install and secure decking material directly atop a concrete surface. More details of example configurations of the presently disclosed flooring system 200 are shown and described hereinbelow with reference to FIG. 3 through FIG. 33.

The floating floor members 202 and the holding floor members 204 of the flooring system 200 can be formed of any long lasting materials that are not substantially effected by the prolonged presence of moisture (i.e., materials that substantially do not rot or degrade with prolonged moisture). That is, the floating floor members 202 and the holding floor members 204 of the flooring system 200 can be formed of any materials suitable for use in non-dry environments, such as any exterior environments and in basements. For example, the floating floor members 202 and the holding floor members 204 can be formed of composite decking materials, PVC decking materials, weather treated wood, and the like. Examples include, but are not limited to, composite decking, such as Trex® composite decking available from Trex Company, Inc. (Winchester, Va.) and TimberTech® composite decking available from TimberTech Building Products (Scranton, Pa.); and cellular PVC decking, such as AZEK® decking available from AZEK® Building Products, Inc. (Scranton, Pa.). These composite decking and PVC decking materials are available in various lengths, such 8, 10, 12, 14, 16, and 20 feet. Also, these composite decking and PVC decking materials are available in various thicknesses and widths, such as 1×6 inch, ¾×6 inch, 1×8 inch, ¾×8 inch, 1×12 inch, and ¾×12 inch.

Referring now to FIG. 3 is a perspective view of an example of the presently disclosed flooring system 200 that includes examples of the floating floor members 202 and the holding floor members 204. For example, the flooring system 200 shown in FIG. 3 includes an arrangement of one-end-notched floor members 210 and a one-side-notched holding member 220 installed atop concrete floor 110. The one-end-notched floor members 210 are an example of the floating floor members 202 described in FIG. 2. The one-side-notched holding member 220 is an example of the holding floor members 204 described in FIG. 2. In one example, each of the one-end-notched floor members 210 and the one-side-notched holding member 220 is about 6 inches wide and about 1 inch thick. However, any width and thickness is possible.

Each of the one-end-notched floor members 210 has a notched end 212 and an un-notched end 214. The notch in the notched end 212 (see FIG. 4) is facing up when installed. The one-side-notched holding member 220 has a notched side 222 and an un-notched side 224. The notch in the notched side 222 (see FIG. 5) is facing down when installed. Multiple one-end-notched floor members 210 are arranged side-by-side with the same orientation atop concrete floor 110. Further, the one-end-notched floor members 210 are arranged tightly together so that their sides are in contact with each other. That is, there is substantially no space between adjacent one-end-notched floor members 210. The number of one-end-notched floor members 210 can vary depending on the area to be covered.

Next, the one-side-notched holding member 220 is arranged in relation to the one-end-notched floor members 210. Namely, the notch in the notched side 222 of the one-side-notched holding member 220 is engaged with the opposing notches of the one-end-notched floor members 210. In so doing, the entire arrangement of the one-end-notched floor members 210 is interlocked with a single one-side-notched holding member 220. Then, the single one-side-notched holding member 220 is secured to the concrete floor 110. In so doing, the single one-side-notched holding member 220 can hold the entire arrangement of the one-end-notched floor members 210 in place atop concrete floor 110 without need of other fastening for the one-end-notched floor members 210. In this configuration, one or both sides of the arrangement of the one-end-notched floor members 210 as well as the un-notched ends 214 of the one-end-notched floor members 210 may abut another structure. Further, in this configuration, the one-side-notched holding member 220 can hold the one-end-notched floor members 210 arranged on one side only of the one-side-notched holding member 220.

Referring now to FIG. 4 is a perspective view and a cross-sectional view of an example of the one-end-notched floor member 210, wherein the cross-sectional view is taken along line A-A of the perspective view. The notched end 212 of the one-end-notched floor member 210 includes a notch 216. The one-end-notched floor member 210 can be, for example, about 6, 8, or 12 inches wide. The one-end-notched floor member 210 has a thickness t. The notch 216 has a height h and a depth d. In one example, both the height h and depth d of the notch 216 is about half the thickness t of the one-end-notched floor member 210. For example, if the thickness t of the one-end-notched floor member 210 is about 1 inch, then both the height h and depth d of the notch 216 is about 0.5 inches. In another example, the height h of the notch 216 is about half the thickness t of the one-end-notched floor member 210 and the depth d of the notch 216 is about equal to the thickness t of the one-end-notched floor member 210. For example, if the thickness t of the one-end-notched floor member 210 is about 1 inch, then the height h of the notch 216 is about 0.5 inches and the depth d of the notch 216 is about 1 inch.

The presence of the notch 216 forms a lip 218 at the notched end 212 of the one-end-notched floor member 210. Accordingly, the height h and depth d of the notch 216 can vary so long as the lip 218 that is formed has suitable structural integrity (i.e., is not easily broken).

Referring now to FIG. 5 is a top perspective view, a bottom perspective view, and a cross-sectional view of an example of the one-side-notched holding member 220, wherein the cross-sectional view is taken along line A-A of the top perspective view. The notched side 222 of the one-side-notched holding member 220 includes a notch 226. The one-side-notched holding member 220 has a width w and a thickness t. The width w can be, for example, about 6 inches or about 8 inches. The notch 226 has a height h and a depth d. In one example, both the height h and depth d of the notch 226 is about half the thickness t of the one-side-notched holding member 220. For example, if the thickness t of the one-side-notched holding member 220 is about 1 inch, then both the height h and depth d of the notch 226 is about 0.5 inches. In another example, the height h of the notch 226 is about half the thickness t of the one-side-notched holding member 220 and the depth d of the notch 226 is about equal to the thickness t of the one-side-notched holding member 220. For example, if the thickness t of the one-side-notched holding member 220 is about 1 inch, then the height h of the notch 226 is about 0.5 inches and the depth d of the notch 226 is about 1 inch.

The presence of the notch 226 forms a lip 228 at the notched side 222 of the one-side-notched holding member 220. Accordingly, the height h and depth d of the notch 226 can vary so long as the lip 228 that is formed has suitable structural integrity (i.e., is not easily broken).

Referring now to FIG. 6 is a perspective view of another example of the presently disclosed flooring system 200 that includes other examples of the floating floor members 202 and the holding floor members 204. For example, the flooring system 200 shown in FIG. 6 includes an arrangement of the one-end-notched floor members 210 and a two-side-notched holding member 230. Again, the one-end-notched floor members 210 are an example of the floating floor members 202 described in FIG. 2. The two-side-notched holding member 230 is another example of the holding floor members 204 described in FIG. 2. In one example, each of the one-end-notched floor members 210 and the two-side-notched holding member 230 is about 6 inches wide and about 1 inch thick. However, any width and thickness is possible.

The two-side-notched holding member 230 has two notched sides 222, each with a notch. The notches in the notched sides 222 (see FIG. 7) are facing down when installed. A first arrangement of one-end-notched floor members 210 is provided with the notched ends 212 oriented the same way. Then, a second arrangement of one-end-notched floor members 210 is provided with the notched ends 212 oriented the same way and facing the notched ends 212 of the first arrangement of one-end-notched floor members 210.

Next, the two-side-notched holding member 230 is arranged in relation to both arrangements of one-end-notched floor members 210. Namely, the notched sides 222 of the two-side-notched holding member 230 are engaged with both the notched ends 212 of the first arrangement of one-end-notched floor members 210 and the notched ends 212 of the second arrangement of one-end-notched floor members 210.

In so doing, both arrangements of the one-end-notched floor members 210 are interlocked with a single two-side-notched holding member 230. Then, the single two-side-notched holding member 230 is secured to the concrete floor 110. In so doing, the single two-side-notched holding member 230 can hold both arrangements of the one-end-notched floor members 210 in place atop concrete floor 110 without need of other fastening for the one-end-notched floor members 210. In this configuration, one or both sides of the arrangements of one-end-notched floor members 210 as well as the un-notched ends 214 of the one-end-notched floor members 210 may abut another structure. Further, a feature of this configuration is that the two-side-notched holding member 230 can hold the one-end-notched floor members 210 arranged on both sides thereof.

Referring now to FIG. 7 is a top perspective view, a bottom perspective view, and a cross-sectional view of an example of the two-side-notched holding member 230, wherein the cross-sectional view is taken along line A-A of the top perspective view. The two-side-notched holding member 230 has the notched side 222 on both sides. Each of the notched sides 222 of the two-side-notched holding member 230 includes the notch 226 and the lip 228, as described in FIG. 5.

Referring now to FIG. 8 is a perspective view of another example of the presently disclosed flooring system 200 that includes yet other examples of the floating floor members 202 and the holding floor members 204. For example, the flooring system 200 shown in FIG. 8 includes an arrangement of two-end-notched floor members 240 and two of the one-side-notched holding member 220. The two-end-notched floor members 240 are another example of the floating floor members 202 described in FIG. 2. Again, the one-side-notched holding member 220 is an example of the holding floor members 204 described in FIG. 2. In one example, each of the two-end-notched floor members 240 and the one-side-notched holding member 220 is about 6 inches wide and about 1 inch thick. However, any width and thickness is possible.

Each of the two-end-notched floor members 240 has two notched ends 212 and no un-notched end 214 (see FIG. 9). Multiple two-end-notched floor members 240 are arranged side-by-side. Further, the two-end-notched floor members 240 are arranged tightly together so that their sides are in contact with each other. That is, there is substantially no space between adjacent two-end-notched floor members 240. The number of two-end-notched floor members 240 can vary depending on the area to be covered.

Next, one of the one-side-notched holding member 220 is arranged in relation to the one end of the two-end-notched floor members 240. The other one-side-notched holding member 220 is arranged in relation to the other end of the two-end-notched floor members 240. In so doing, the entire arrangement of the two-end-notched floor members 240 is interlocked between a pair of one-side-notched holding members 220. Then, the pair of one-side-notched holding members 220 are secured to the concrete floor 110. In so doing, the pair of one-side-notched holding members 220 can hold the entire arrangement of the two-end-notched floor members 240 in place atop concrete floor 110 without need of other fastening for the two-end-notched floor members 240. In this configuration, one or both sides of the arrangement of the two-end-notched floor members 240 may abut another structure.

Referring now to FIG. 9 is a perspective view and a cross-sectional view of an example of the two-end-notched floor member 240, wherein the cross-sectional view is taken along line A-A of the perspective view. The two-end-notched floor member 240 has the notched end 212 on both ends. Each of the notched ends 212 of the two-end-notched floor member 240 includes the notch 216 and the lip 218, as described in FIG. 4.

Referring now to FIG. 10A and FIG. 10B is example methods of securing the holding floor members 204 to a concrete surface. For example, FIG. 10A shows a one-side-notched holding member 220 secured to the concrete floor 110 via an adhesive 250. The adhesive 250 can be, for example, any type of construction adhesive. Examples of construction adhesive include, but are not limited to, Loctite® PL® 375 Heavy Duty Construction Adhesive available from Henkel Corporation, (Westlake Ohio) and DAP® 7000® Construction Adhesive available from DAP Products Inc. (Baltimore, Md.).

FIG. 10B shows a one-side-notched holding member 220 secured to concrete floor 110 via one or more mechanical fasteners 252. The mechanical fasteners 252 can be, for example, screws or nails that are designed to penetrate concrete. In one example, the mechanical fasteners 252 are the Tapcon Concrete Anchors available from ITW Brands (Schaumburg, Ill.). The Tapcon Concrete Anchors are screw type anchors that come with a concrete drill bit. A hole is drilled through the hoding floor member 204 and into the concrete floor 110. Then, the one-side-notched holding member 220 can be screwed to the concrete floor 110 via the Tapcon Concrete Anchor. In one example, the 3/16 inch×2¼ inch Tapcon Concrete Anchor can be used in the flooring system 200.

Referring now to FIG. 11 through FIG. 16 is an example of a process of installing the presently disclosed flooring system 200 directly atop a concrete surface while using minimal fasteners. In this example, the rear portion of the flooring system 200 abuts a wall of a structure, such as that of the standard porch structure 100, and wherein the side portions of the flooring system 200 may or may not abut a structure.

Figure 11:
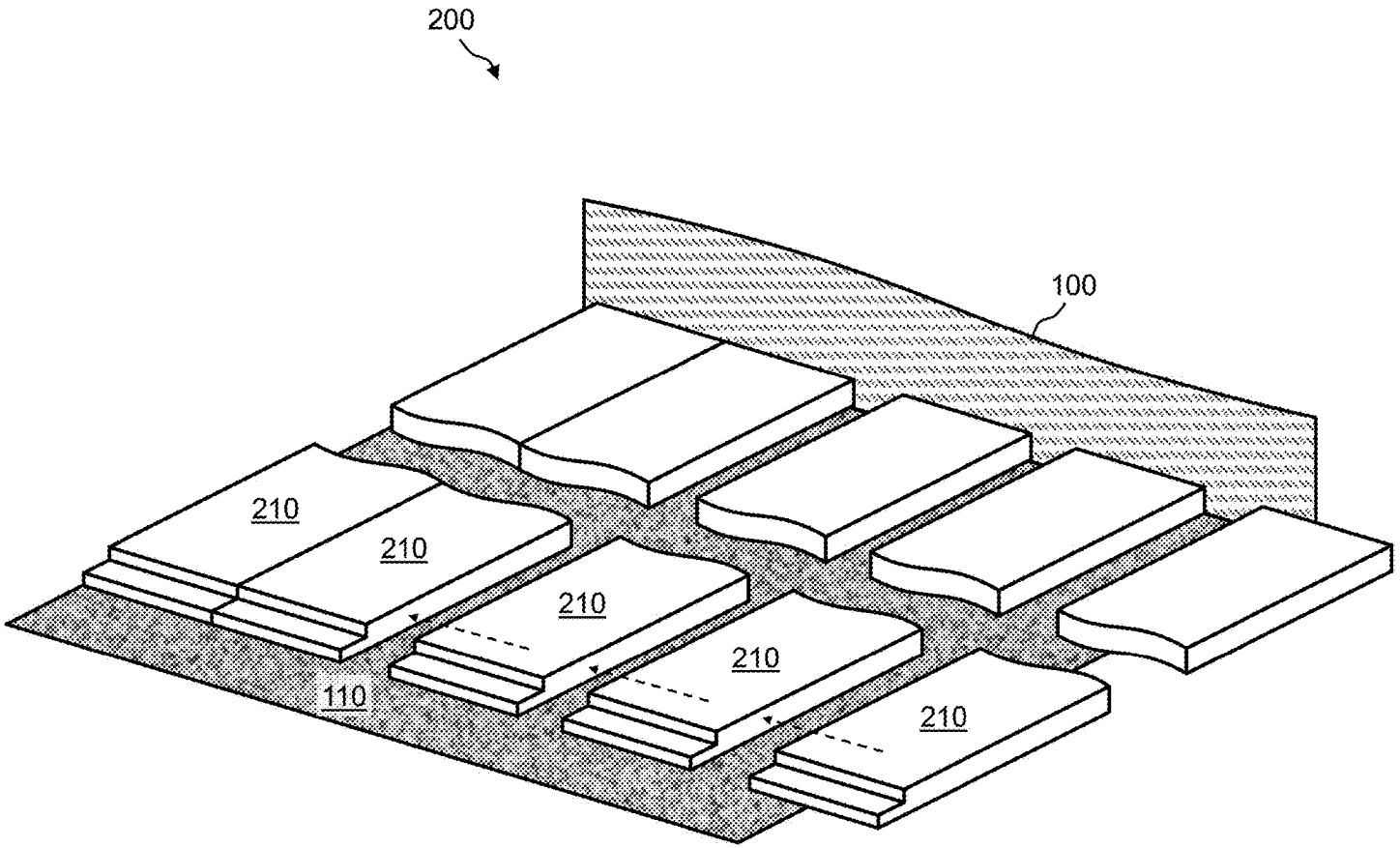
Figure 12:
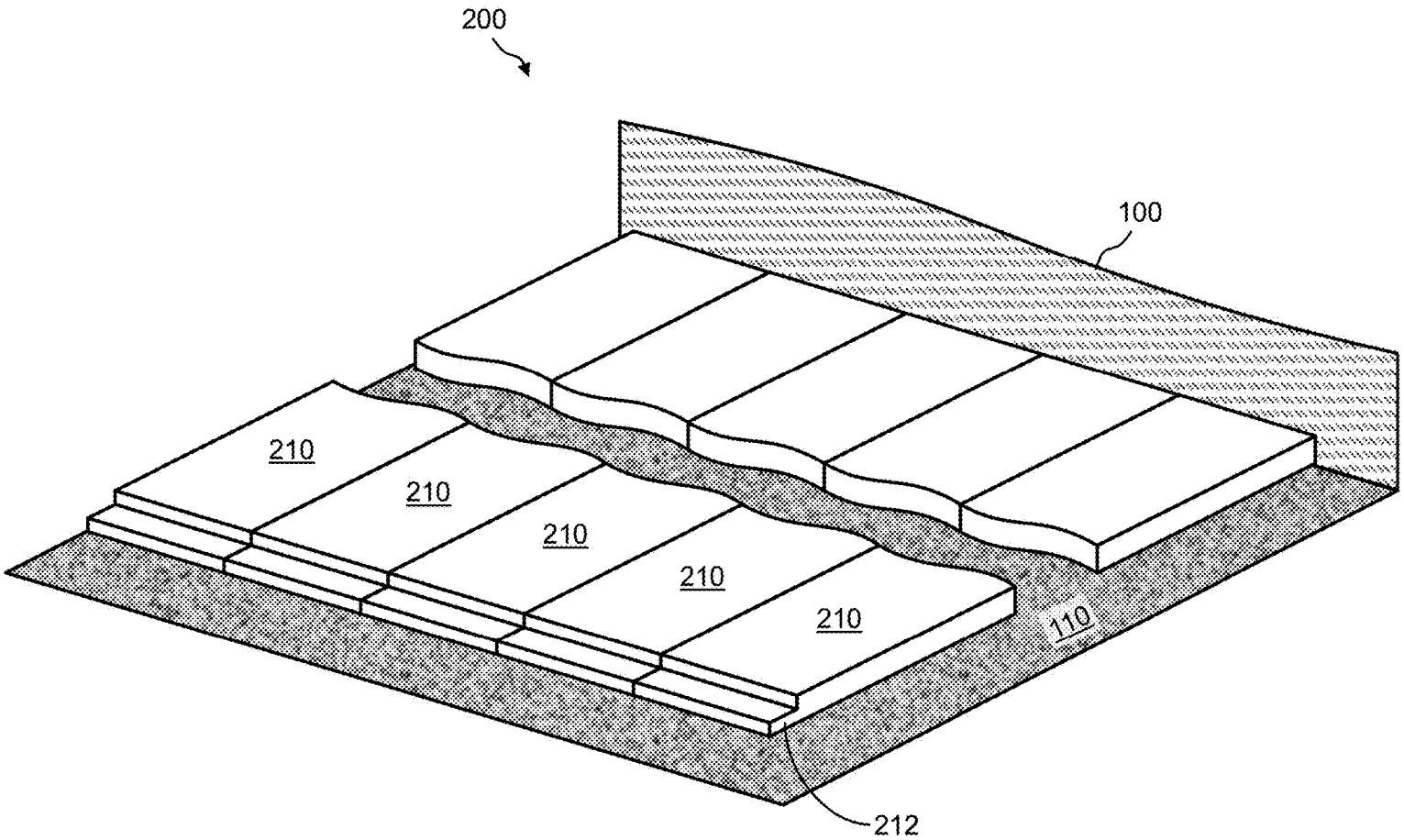

FIG. 11 shows multiple one-end-notched floor members 210 oriented in the same direction and being arranged side-by-side directly atop the concrete floor 110. Again, the one-end-notched floor members 210 are an example of the floating floor members 202 described in FIG. 2. FIG. 12 shows the multiple one-end-notched floor members 210 in place (i.e., side-by-side and touching) directly atop the concrete floor 110. At this point in the process, the one-end-notched floor members 210 are simply held by gravity directly atop the concrete floor 110. All of the notched ends 212 are arranged together and ready to receive any type of holding floor member 204. By contrast, the un-notched ends 214 of the one-end-notched floor members 210 abut the wall of the structure.

Figure 13:
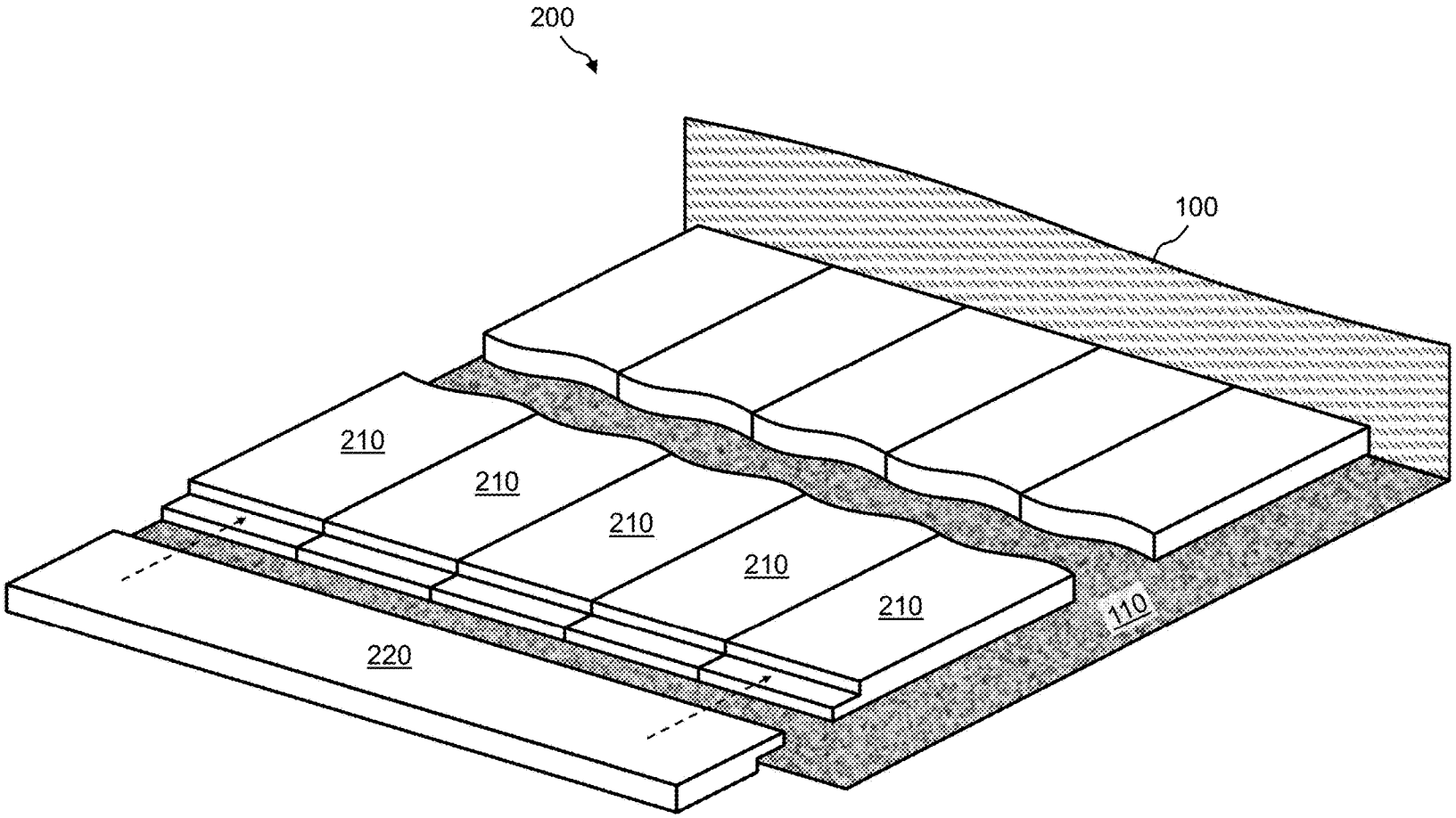
Figure 14:
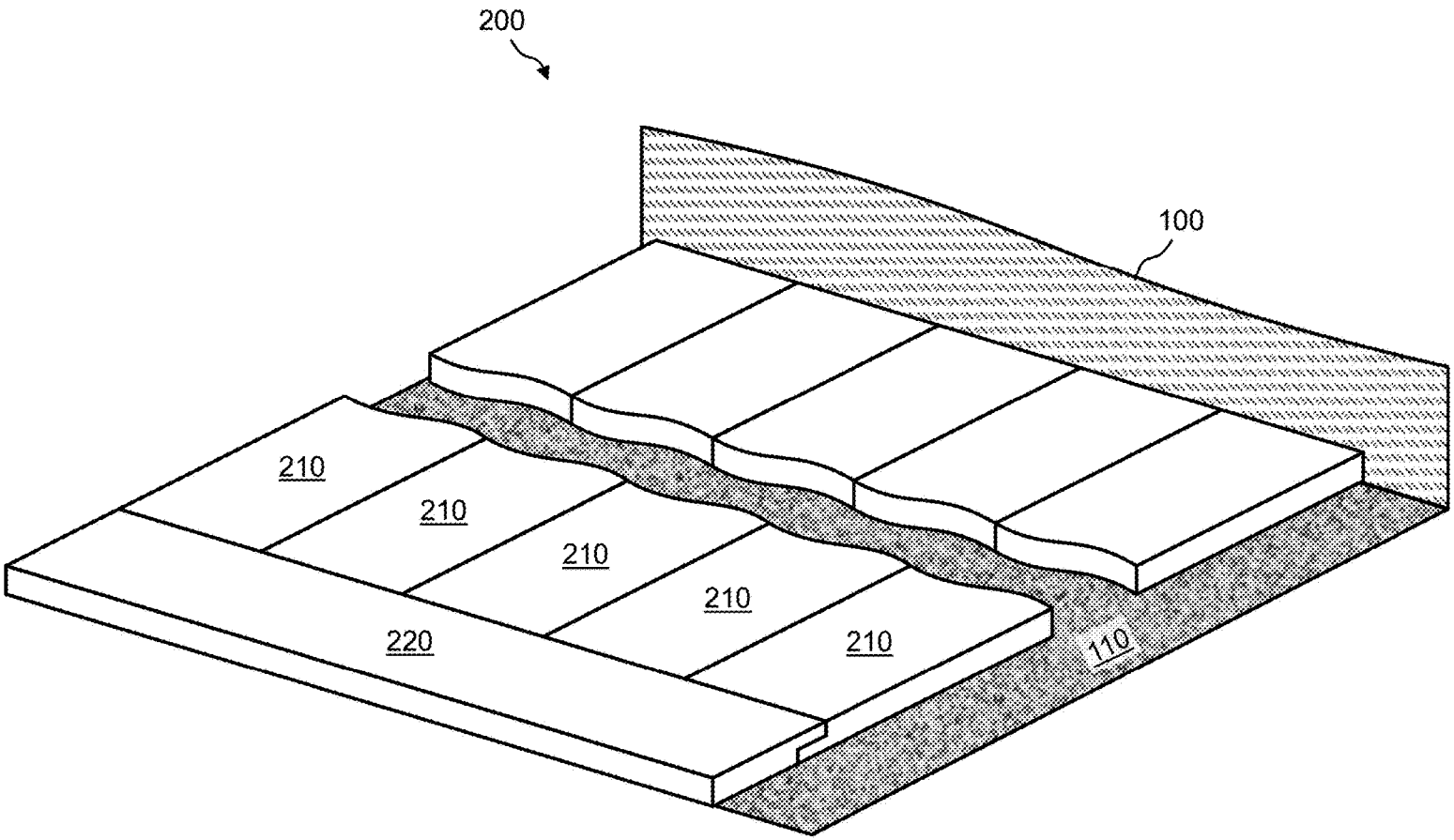
Figure 15:
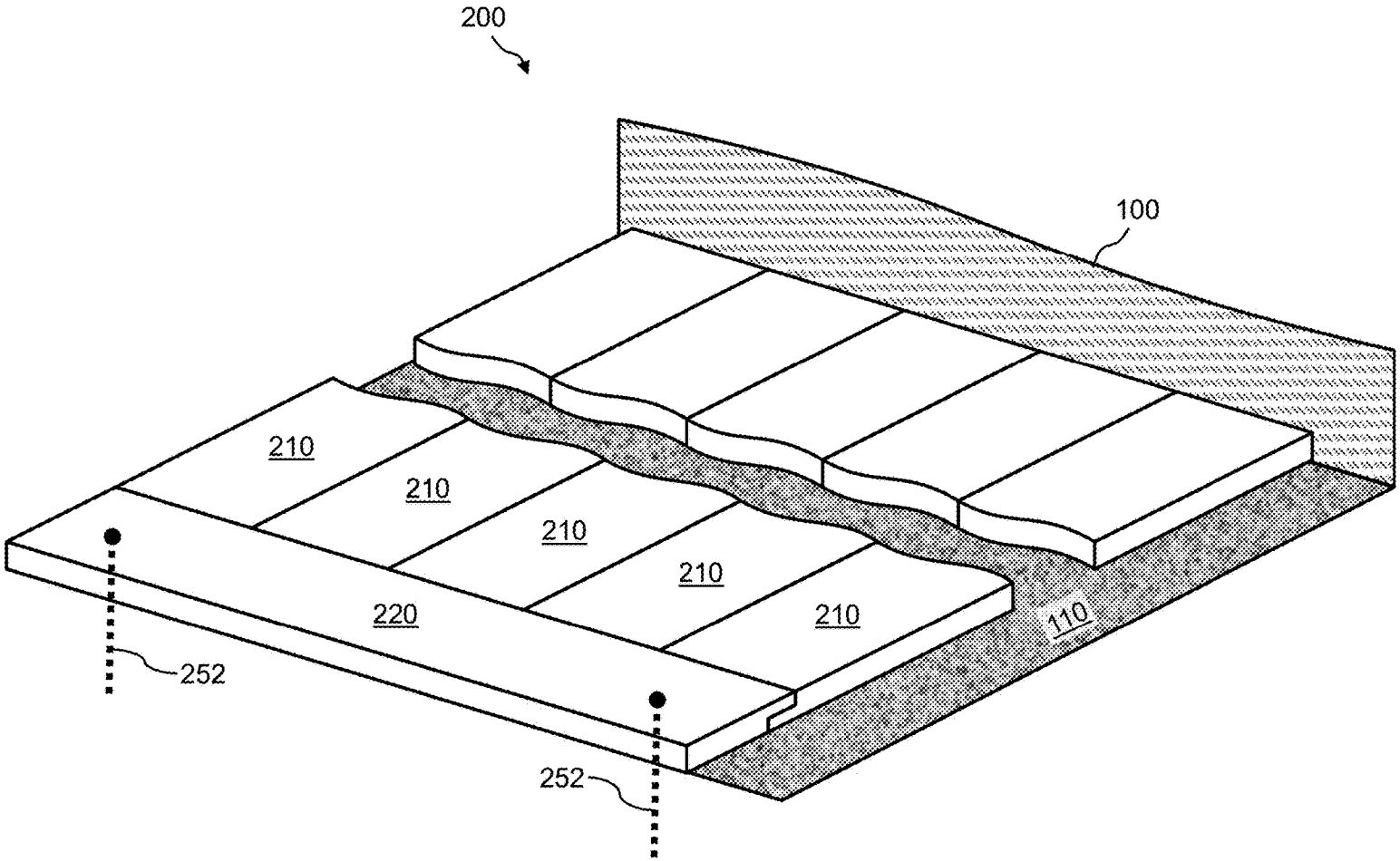

FIG. 13 shows the one-end-notched floor members 210 being arranged in relation the notched ends 212 of the one-end-notched floor members 210. Again, the one-side-notched holding member 220 is an example of the holding floor members 204 described in FIG. 2. FIG. 14 shows the one-side-notched holding member 220 engaged with the notched ends 212 of the one-end-notched floor members 210. FIG. 15 shows the one-side-notched holding member 220 secured to the concrete floor 110 using, e.g., two mechanical fasteners 252. However, the number of mechanical fasteners 252 may depend on the length of the one-side-notched holding member 220. In one example, a mechanical fastener 252 may be installed every 4 feet along the one-side-notched holding member 220. In so doing, the one-side-notched holding member 220 is used to hold the one-end-notched floor members 210 in place atop the concrete floor 110.

Figure 16:
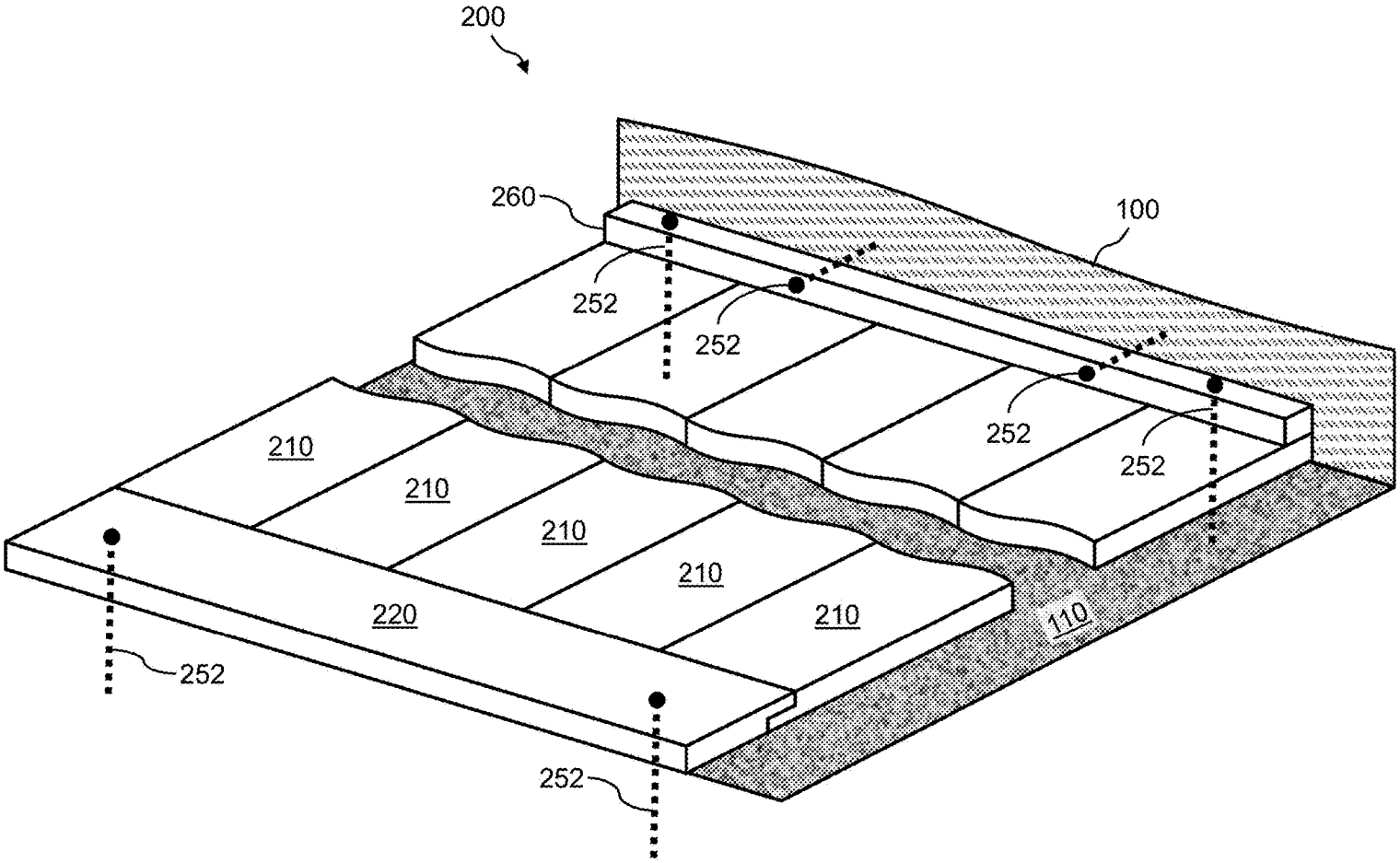

FIG. 16 shows an example of one way to secure the un-notched ends 214 of the one-end-notched floor members 210. Because the un-notched ends 214 of the one-end-notched floor members 210 abut the wall of the structure, a holding strip 260 can be installed at the junction of the one-end-notched floor members 210 and the wall. In one example, mechanical fasteners 252 can be installed vertically through the holding strip 260, the one-end-notched floor members 210, and into the concrete floor 110. In another example, mechanical fasteners 252 can be installed horizontally through the holding strip 260 and into the wall of the structure.

Multiple configurations of the floating floor members 202, the holding floor member 204, and fastening schemes (e.g., adhesive 250, mechanical fasteners 252) in the presently disclosed flooring system 200 are possible. By way of example, FIG. 17A through FIG. 21C show examples of different configurations of the presently disclosed flooring system 200 installed directly atop a concrete surface while using minimal fasteners. While FIG. 17A through FIG. 21C show the mechanical fasteners 252, the adhesive 250 can be used instead of or in combination with the mechanical fasteners 252 or in combination. Further, the fastening schemes can vary depending on abutting structures, wherein abutting structures can be used to retain the positions of certain floor members of the flooring system 200.

Figure 17A:
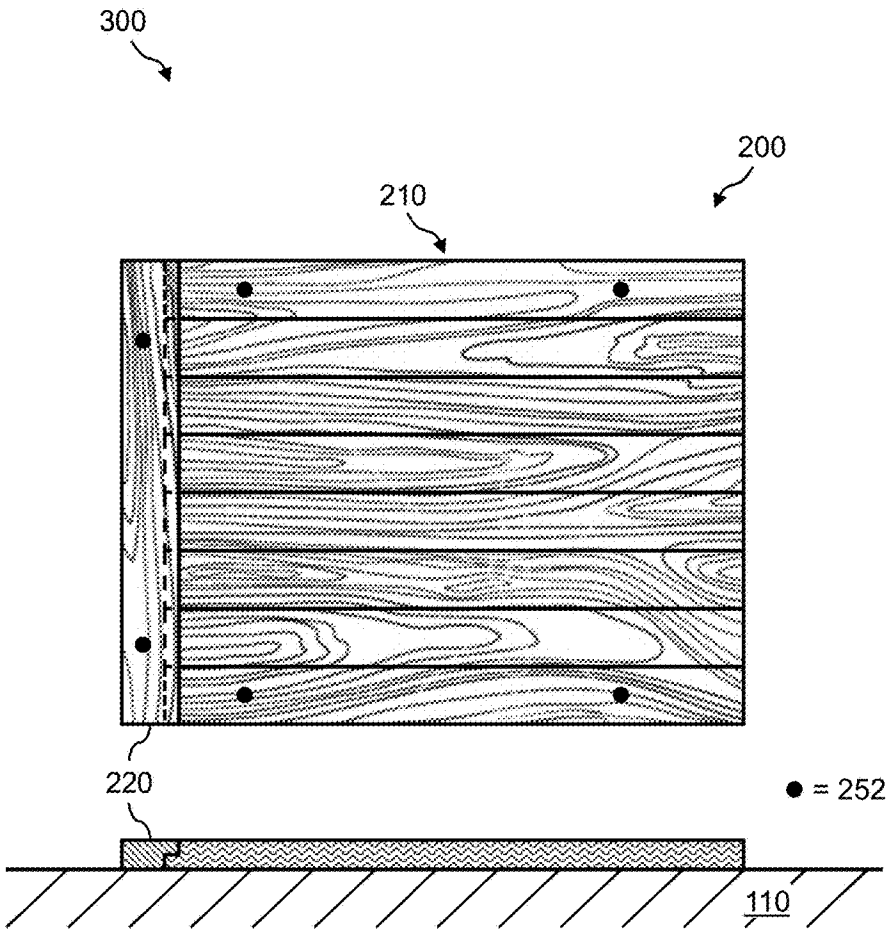
Figure 17B:
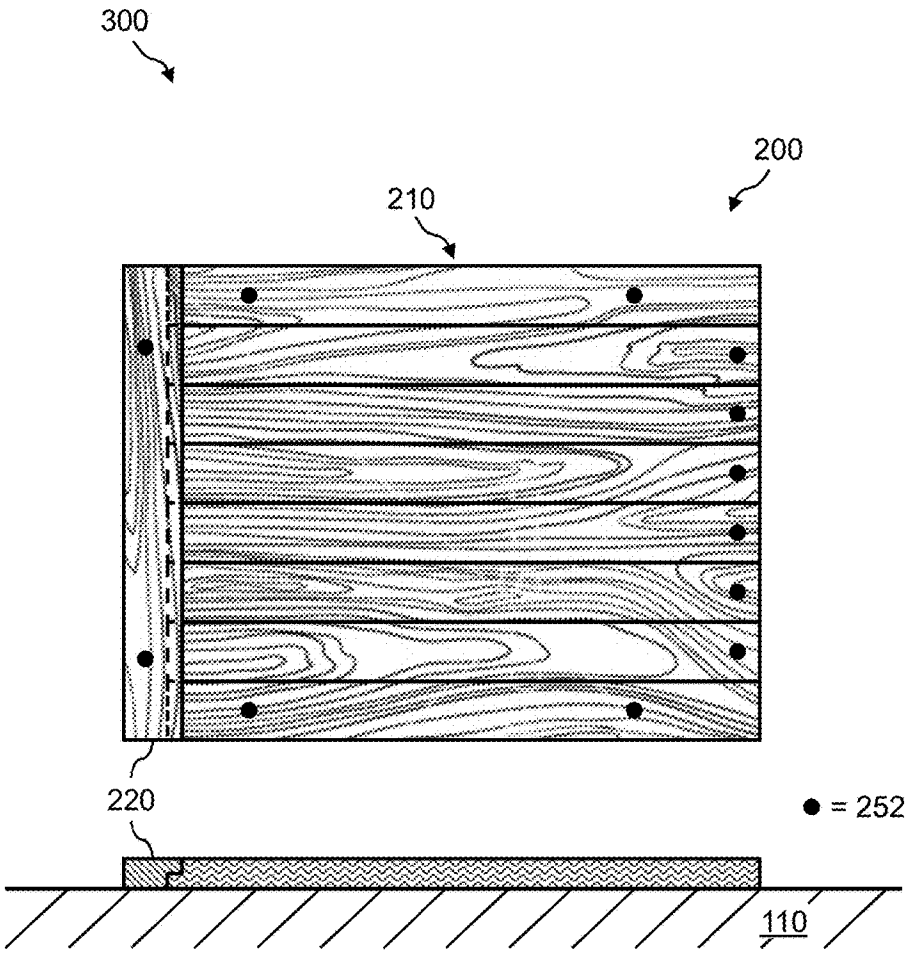

FIG. 17A and FIG. 17B show an arrangement 300 of the one-end-notched floor members 210 in relation to the one-side-notched holding member 220, albeit with different fastening schemes. FIG. 17A shows at least two mechanical fasteners 252 in the one-side-notched holding member 220 and at least two mechanical fasteners 252 in both the two outermost one-end-notched floor members 210. In this example, the two outermost one-end-notched floor members 210 can be considered holding floor members 204. Accordingly, the arrangement 300 of FIG. 17A features as few as three (3) holding floor members 204 only regardless the number of floating floor members 202, which can be in the dozens for a large area floor. Further, the arrangement 300 of FIG. 17A features as few as six (6) mechanical fasteners 252 for the entire installation.

The arrangement 300 of FIG. 17B is substantially the same as FIG. 17A except for one additional mechanical fastener 252 in each of the un-notched ends 214 of the one-end-notched floor members 210. Accordingly, in the configuration shown in arrangement 300 of FIG. 17B, all flooring members are holding floor members, albeit sill with a minimal number of mechanical fasteners 252.

Figure 18A:
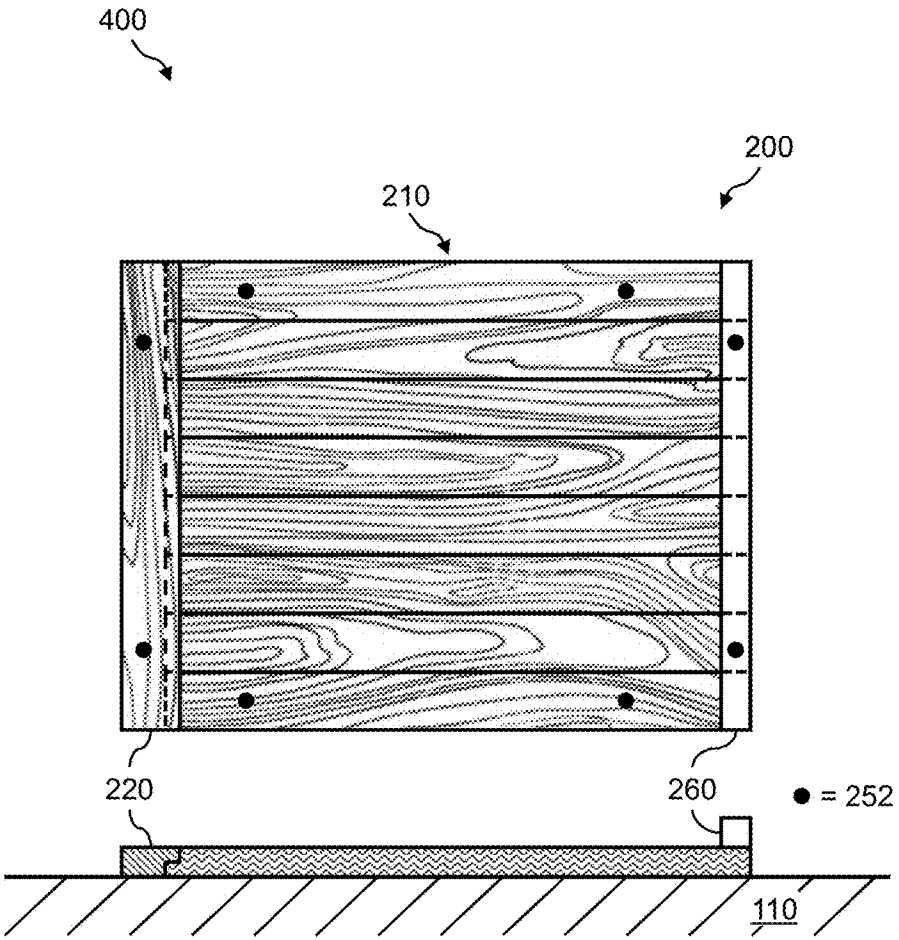
Figure 18B:
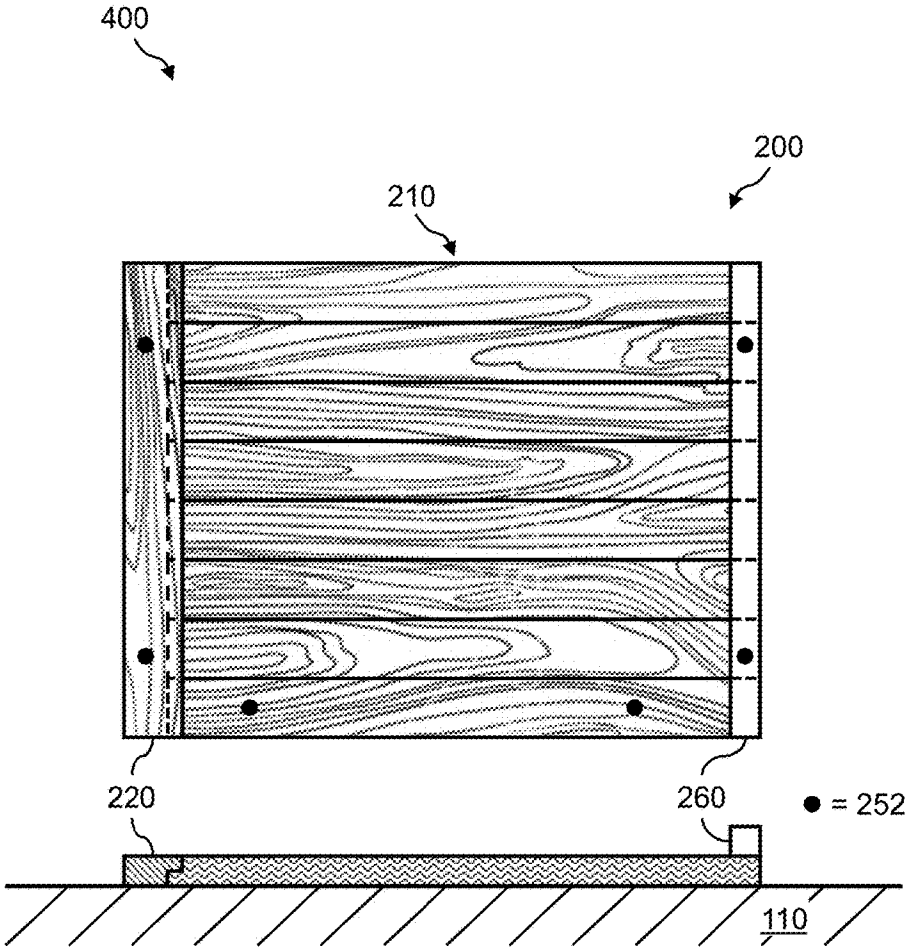
Figure 18C:
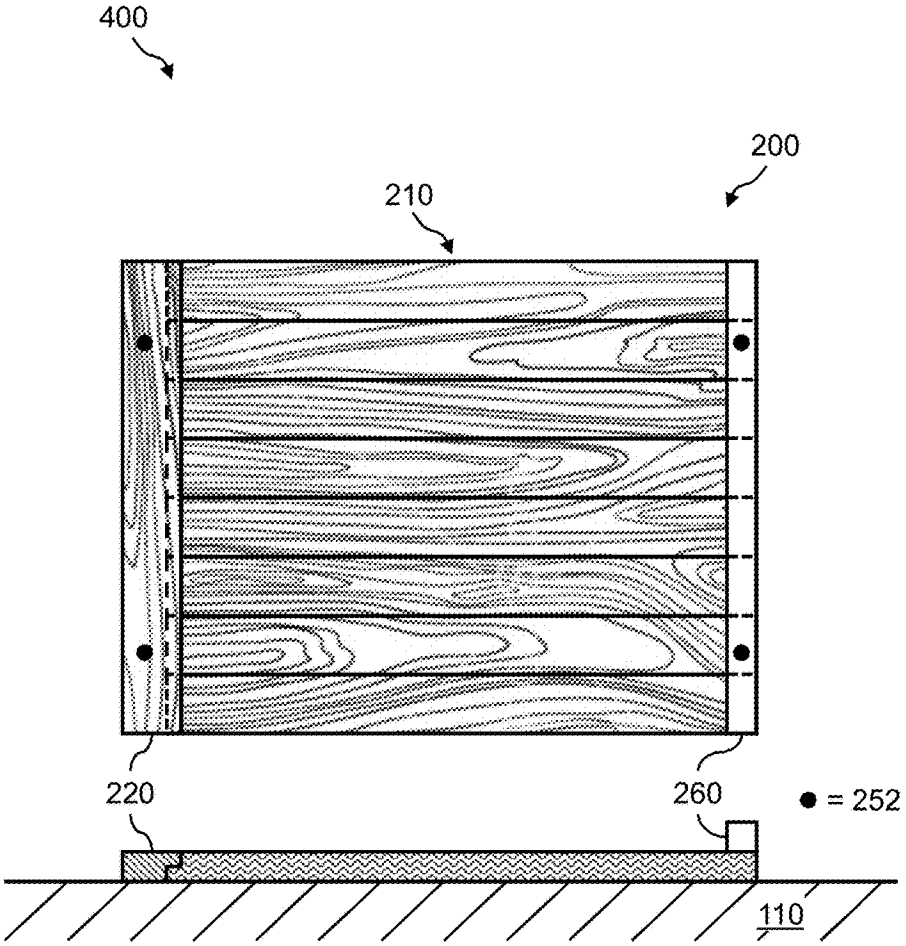

FIG. 18A, FIG. 18B, and FIG. 18C show an arrangement 400 of the one-end-notched floor members 210 in relation to the one-side-notched holding member 220 and the holding strip 260, albeit with different fastening schemes. FIG. 18A shows at least two mechanical fasteners 252 in the one-side-notched holding member 220, at least two mechanical fasteners 252 in both the two outermost one-end-notched floor members 210, and at least two mechanical fasteners 252 in the holding strip 260. In this example, the two outermost one-end-notched floor members 210 and the holding strip 260 can be considered holding floor members 204. Accordingly, the arrangement 400 of FIG. 18A features as few as four (4) holding floor members 204 only regardless the number of floating floor members 202, which can be in the dozens for a large area floor. Further, the arrangement 400 of FIG. 18A features as few as eight (8) mechanical fasteners 252 for the entire installation. FIG. 26 shows an example of the presently disclosed flooring system 200 that uses the arrangement 400 of FIG. 18A.

The arrangement 400 of FIG. 18B is substantially the same as FIG. 18A except for the absence of mechanical fasteners 252 in one of the outermost one-end-notched floor members 210. For example, one side of arrangement 400 may abut a wall, which holds this outermost one-end-notched floor member 210 in position and obviates the need for fastening. FIG. 27 shows an example of the presently disclosed flooring system 200 that uses the arrangement 400 of FIG. 18B. The arrangement 400 of FIG. 18C is substantially the same as FIG. 18A except for the absence of mechanical fasteners 252 in both of the outermost one-end-notched floor members 210. For example, both sides of arrangement 400 may abut a wall, which holds these outermost one-end-notched floor members 210 in position and obviates the need for fastening.

Figure 19A:
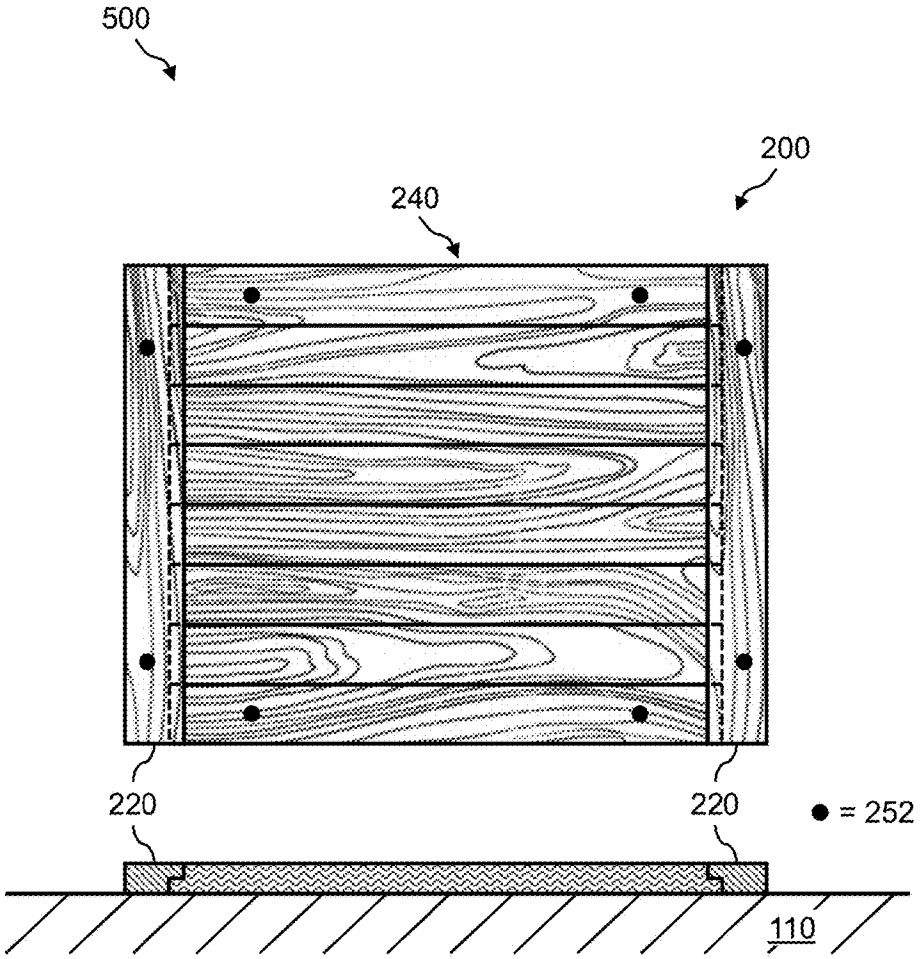
Figure 19B:
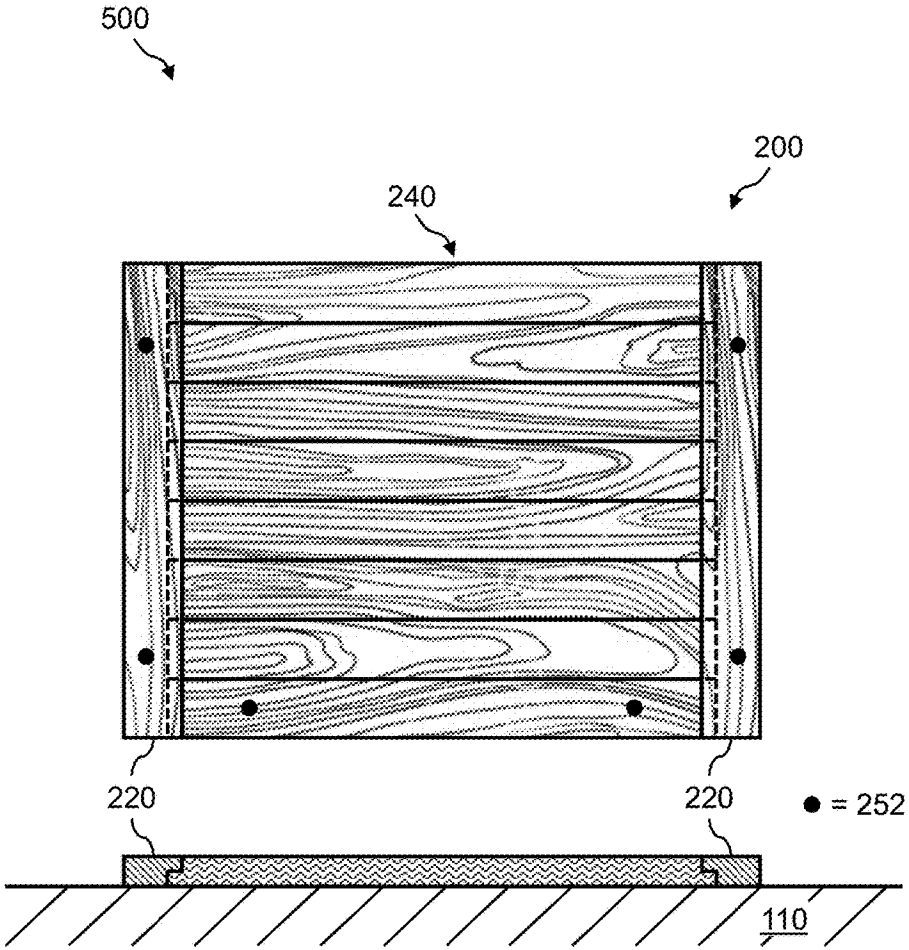
Figure 19C:
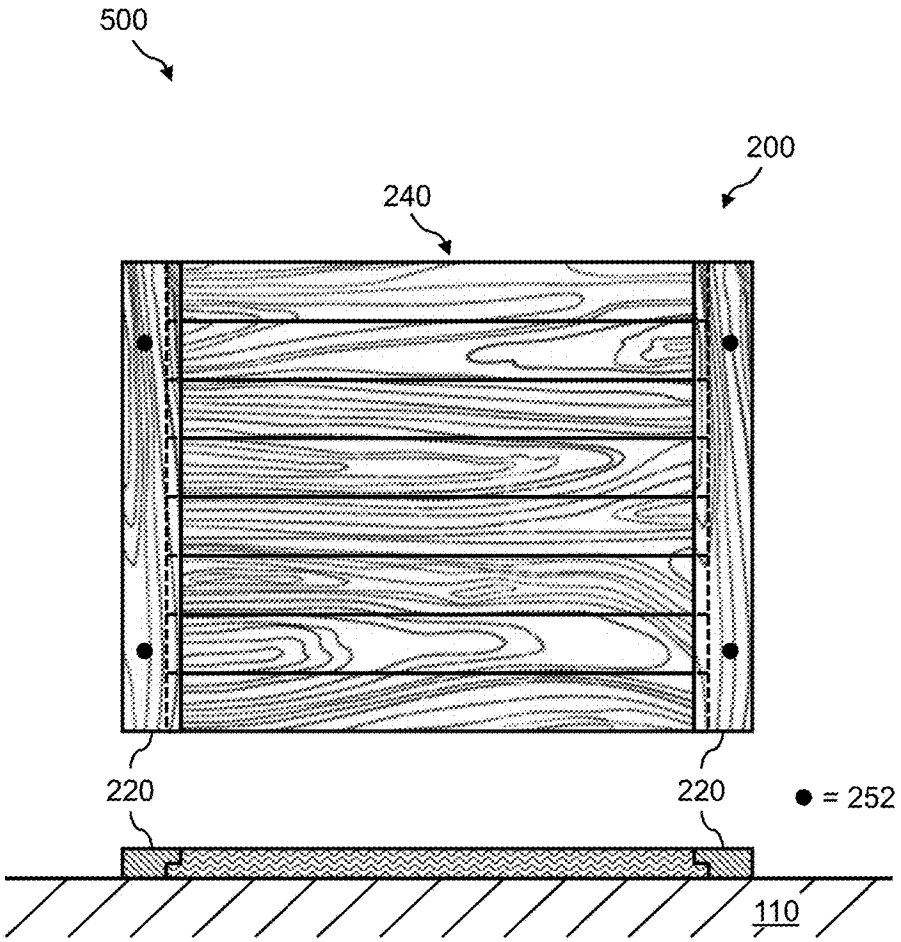

FIG. 19A, FIG. 19B, and FIG. 19C show an arrangement 500 of the two-end-notched floor members 240 arranged between two one-side-notched holding members 220, albeit with different fastening schemes. FIG. 19A shows at least two mechanical fasteners 252 in both the one-side-notched holding members 220, and at least two mechanical fasteners 252 in both the two outermost one-end-notched floor members 210. In this example, the two outermost one-end-notched floor members 210 can be considered holding floor members 204. Accordingly, the arrangement 500 of FIG. 19A features as few as four (4) holding floor members 204 only regardless the number of floating floor members 202, which can be in the dozens for a large area floor. Further, the arrangement 500 of FIG. 19A features as few as eight (8) mechanical fasteners 252 for the entire installation.

The arrangement 500 of FIG. 19B is substantially the same as FIG. 19A except for the absence of mechanical fasteners 252 in one of the outermost one-end-notched floor members 210. For example, one side of arrangement 500 may abut a wall, which holds this outermost one-end-notched floor member 210 in position and obviates the need for fastening. The arrangement 500 of FIG. 19C is substantially the same as FIG. 19A except for the absence of mechanical fasteners 252 in both of the outermost one-end-notched floor members 210. For example, both sides of arrangement 500 may abut a wall, which holds these outermost one-end-notched floor members 210 in position and obviates the need for fastening.

Figure 20A:
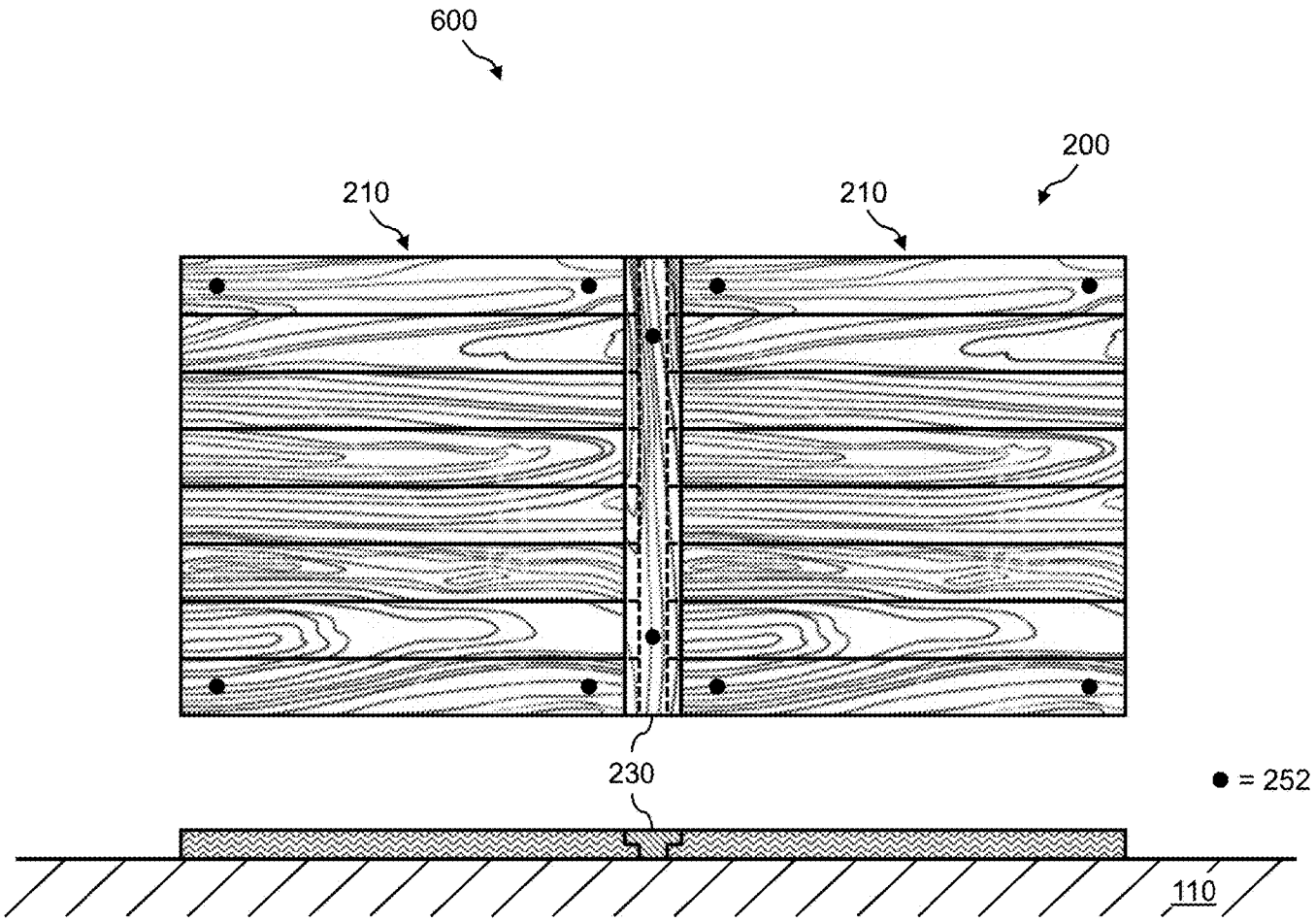
Figure 20B:
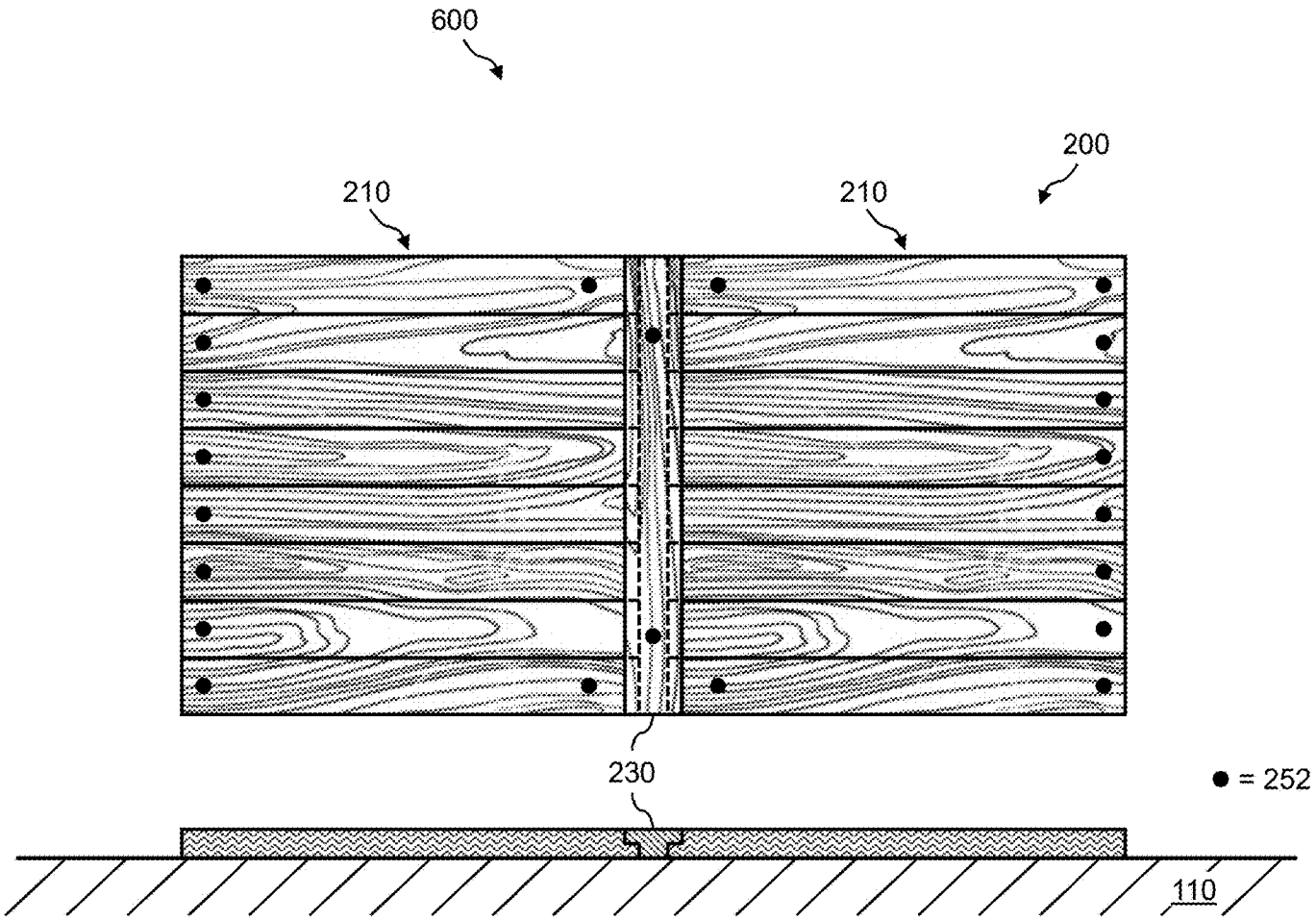
Figure 20C:
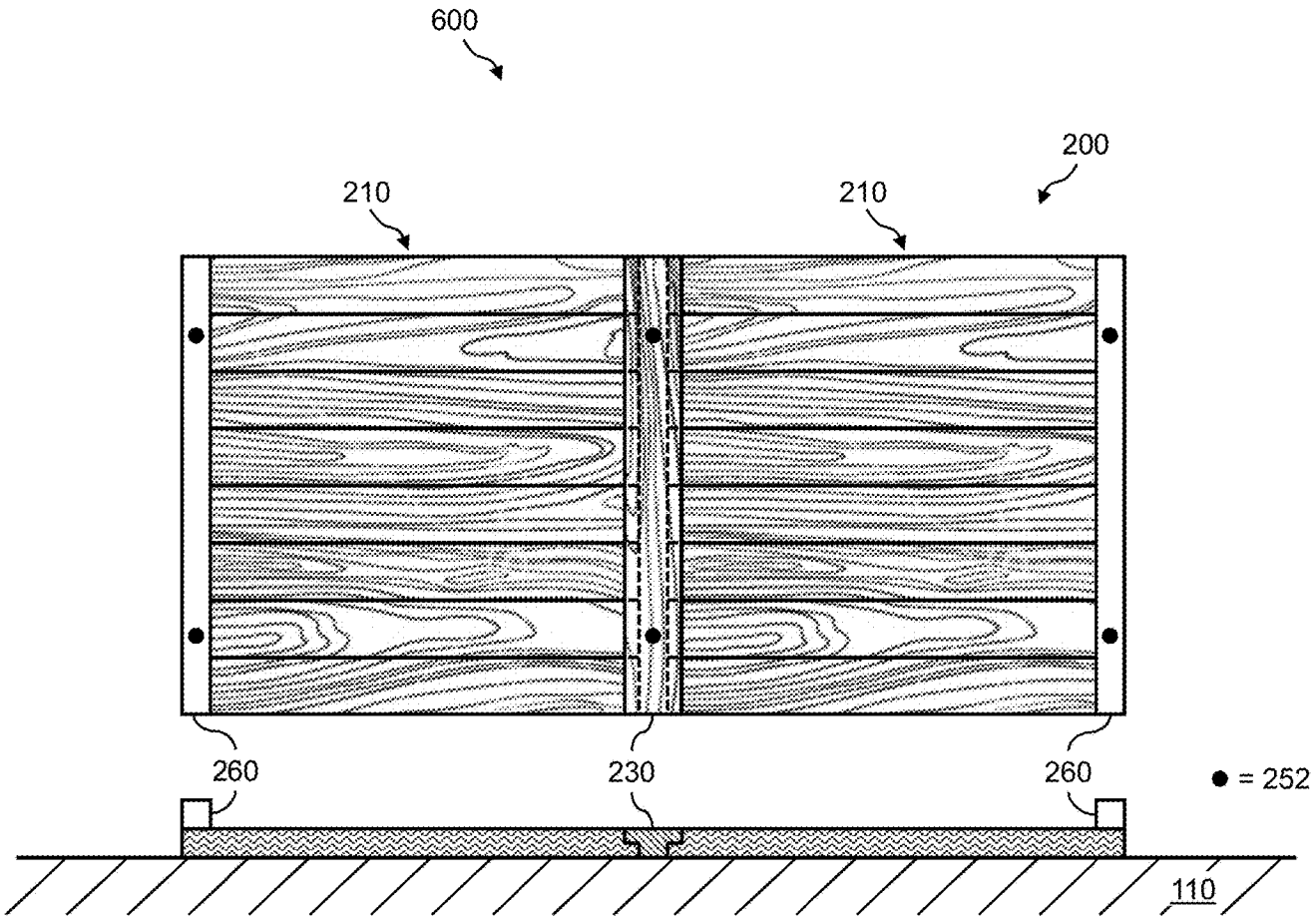

FIG. 20A, FIG. 20B, and FIG. 20C show an arrangement 600 of one two-side-notched holding member 230 in relation to two arrangements of one-end-notched floor members 210, albeit with different fastening schemes. FIG. 20A shows at least two mechanical fasteners 252 in the two-side-notched holding member 230, at least two mechanical fasteners 252 in both the two outermost one-end-notched floor members 210 of the first arrangement, and at least two mechanical fasteners 252 in both the two outermost one-end-notched floor members 210 of the second arrangement. In this example, the outermost one-end-notched floor members 210 can be considered holding floor members 204. Accordingly, the arrangement 600 of FIG. 20A features as few as five (5) holding floor members 204 only regardless the number of floating floor members 202, which can be in the dozens for a large area floor. Further, the arrangement 600 of FIG. 20A features as few as ten (10) mechanical fasteners 252 for the entire installation.

The arrangement 600 of FIG. 20B is substantially the same as FIG. 20A except for one additional mechanical fastener 252 in each of the un-notched ends 214 of the one-end-notched floor members 210. Accordingly, in the configuration shown in arrangement 600 of FIG. 20B, all flooring members are holding floor members, albeit sill with a minimal number of mechanical fasteners 252. The arrangement 600 of FIG. 20C is substantially the same as FIG. 20A except for the addition of the holding strip 260 on each end and no fastening of any one-end-notched floor members 210. For example, both sides of arrangement 600 may abut a wall, which holds the outermost one-end-notched floor members 210 in position and obviates the need for fastening.

Figure 21A:
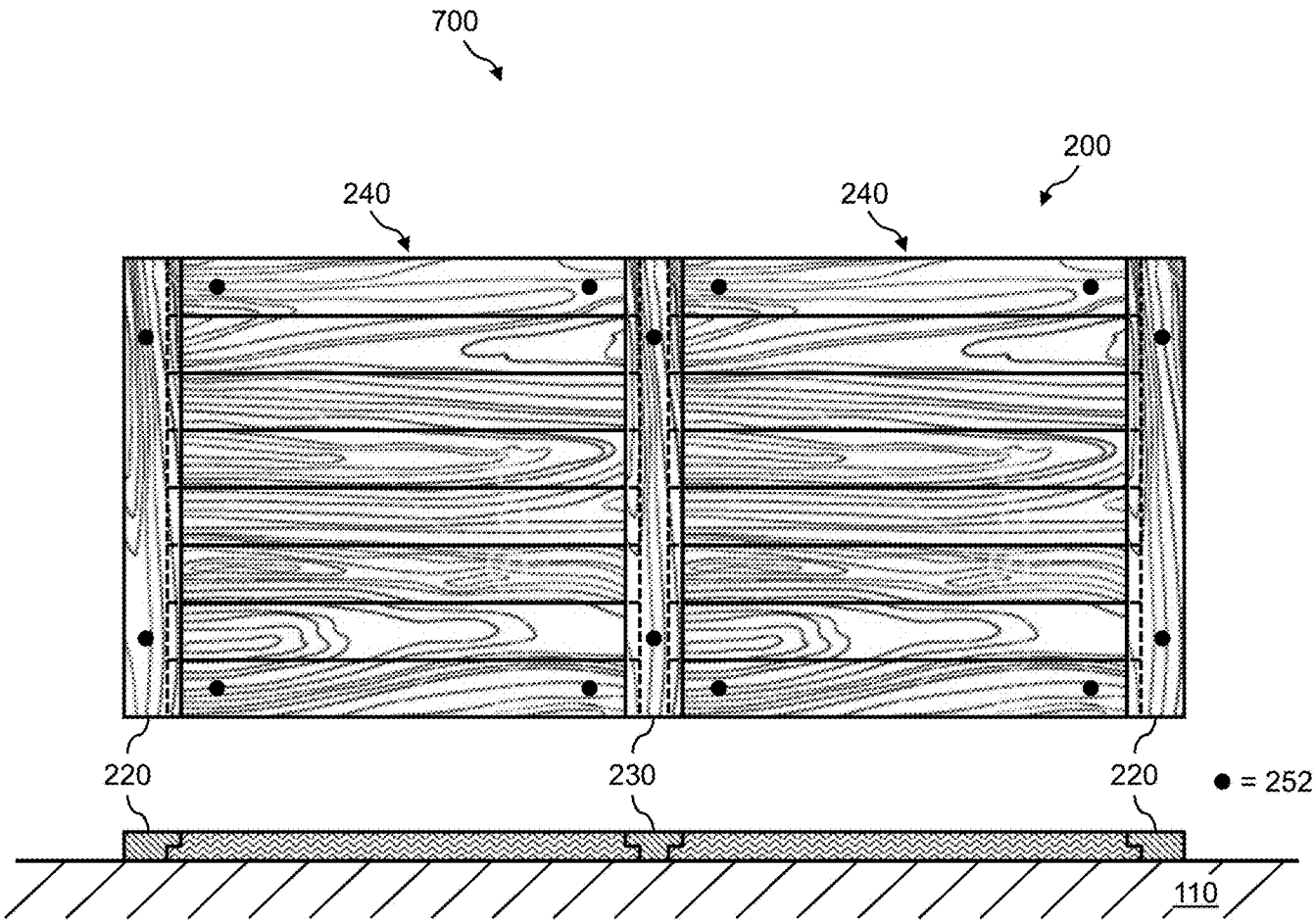
Figure 21B:
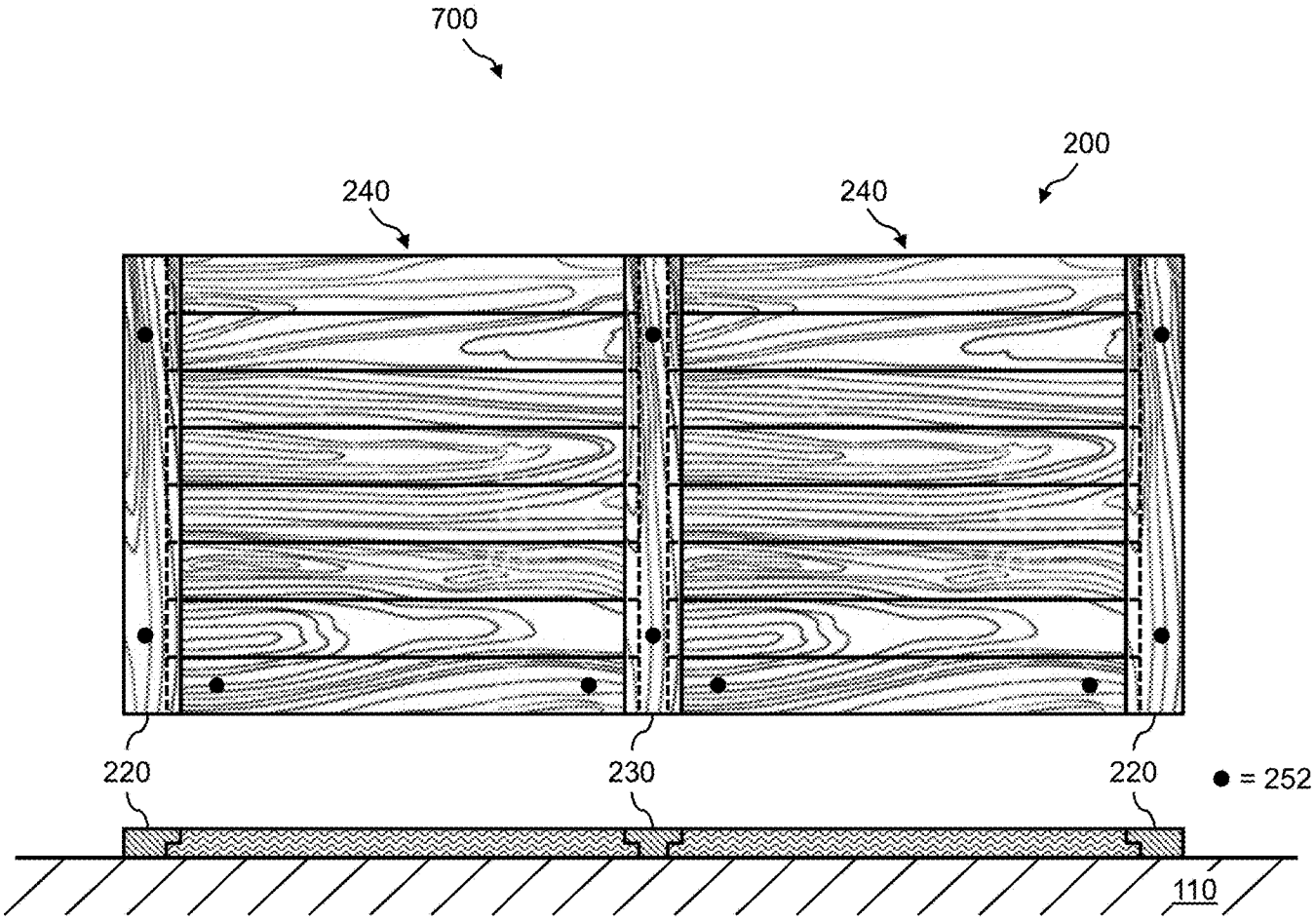
Figure 21C:
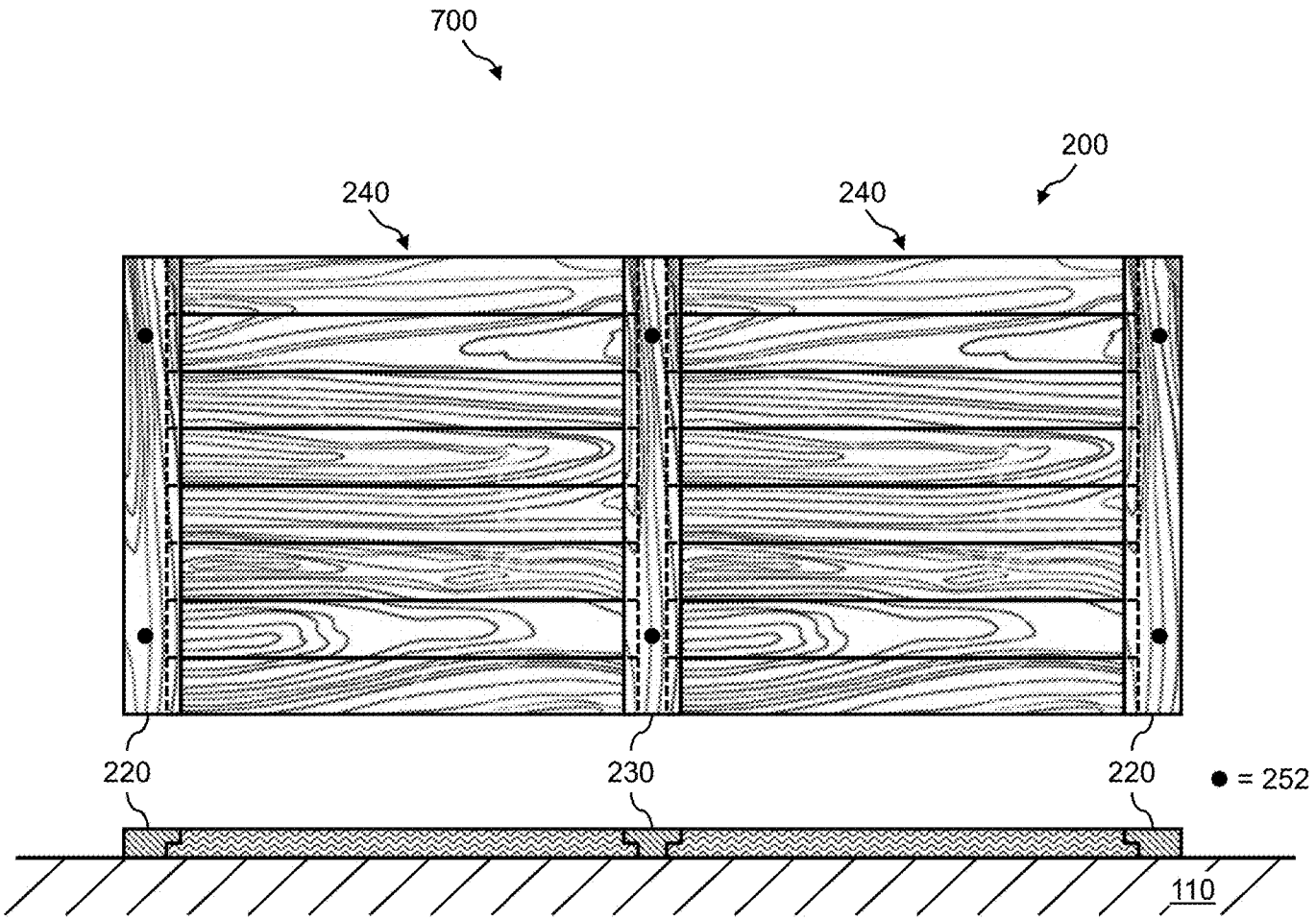

FIG. 21A, FIG. 21B, and FIG. 21C show an arrangement 700 of one two-side-notched holding member 230 and two one-side-notched holding members 220 for holding two arrangements of two-end-notched floor members 240, albeit with different fastening schemes. FIG. 21A shows at least two mechanical fasteners 252 in the two-side-notched holding member 230, at least two mechanical fasteners 252 in both the one-side-notched holding members 220, at least two mechanical fasteners 252 in both the two outermost two-end-notched floor members 240 of the first arrangement, and at least two mechanical fasteners 252 in both the two outermost two-end-notched floor members 240 of the second arrangement. In this example, the outermost two-end-notched floor members 240 can be considered holding floor members 204. Accordingly, the arrangement 700 of FIG. 21A features as few as seven (7) holding floor members 204 only regardless the number of floating floor members 212, which can be in the dozens for a large area floor. Further, the arrangement 700 of FIG. 21A features as few as fourteen (14) mechanical fasteners 252 for the entire installation.

The arrangement 700 of FIG. 21B is substantially the same as FIG. 21A except for the absence of mechanical fasteners 252 in two of the outermost two-end-notched floor members 240. For example, one side of arrangement 700 may abut a wall, which holds these outermost two-end-notched floor members 240 in position and obviates the need for fastening. The arrangement 700 of FIG. 21C is substantially the same as FIG. 21A except for the absence of mechanical fasteners 252 in all of the outermost two-end-notched floor members 240. For example, both sides of arrangement 700 may abut a wall, which holds these outermost two-end-notched floor members 240 in position and obviates the need for fastening.

Referring again to the configurations shown in FIG. 17A through 21C, in the presently disclosed flooring system 200, the floor members are laid directly atop the concrete surface, wherein the majority of floor members are the floating floor members 202 that can be held by a small number of the holding floor members 204. Further, both the floating floor members 202 and the holding floor members 204 include features, such as notches, that allow the floating floor members 202 to interlock with the holding floor members 204 and obviate the need for other fastening of the floating floor members 202. Additionally, the floating floor members 202 greatly outnumber the holding floor members 204 and because only the holding floor members 204 require fastening, the amount of mechanical fasteners required in the presently disclosed flooring system 200 is greatly reduced compared to conventional flooring/decking systems. Accordingly, the presently disclosed flooring system provides an easy way to install and secure decking material directly atop a concrete surface.

For example, to install the flooring portion of a conventional flooring/decking system, such as a 12-ft×12-ft deck, requires, for example, 24 6-inch wide floor boards. If nailed or screwed every 16 inches, the entire installation would require 480 nails or screws (20 per board). By contrast, and referring now again to the configuration 400 shown in FIG. 18A and the configuration 500 shown in FIG. 19A, the same configuration using the presently disclosed flooring system 200 includes 22 floating floor members 202 (that require no mechanical fastening) interlocked with 4 holding floor members 204 only, wherein each of the 4 holding floor members 204 can require as few as 2 mechanical fasteners 252 only, for a total of 8 mechanical fasteners 252 for the entire installation. In this example, 8 concrete fasteners is very feasible for the entire 12-ft×12-ft installation, wherein using 480 concrete fasteners would be very difficult and not feasible. Namely, in this example, there is about a 98% reduction in the number of mechanical fasteners compared to conventional floor systems.

The floor members of the presently disclosed flooring system 200 may include other features. In one example, FIG. 22 shows a set of drainage channels 242 can be provided along the underside of any floor member, such as two-end-notched floor members 240. Because the floor members of the flooring system 200 can lay directly atop the concrete surface, the drainage channels 242 may allow any moisture that accumulates beneath flooring system 200 to drain. Further, the presence of the drainage channels 242 may allow the flooring system 200 to "breath." The number and spacing of the drainage channels 242 can vary. Further, the depth and width of the drainage channels 242 can vary. In one example, each drainage channel 242 is about 0.125 inches wide and about 0.125 inches deep.

In another example, FIG. 23A shows a ramp feature 221 integrated into the upper surface of any floor member that abuts a step (or stair). The ramp feature 221 provides a step transition feature to compensate for the additional thickness of flooring system 200 at the location of a step (or stair). FIG. 23B shows a separate ramp strip 223 that can be installed at the leading edge of the floor member. In yet another example, FIG. 24 shows an example of the one-side-notched holding member 220 that has a beveled edge 225. The beveled edge 225 can be set at any angle. For example, the angle of the beveled edge 225 can be about 30 degrees, about 45 degrees, or about 60 degrees. Where needed or desired, any floating floor member 202 and any holding floor member 204 of the flooring system 200 can have a beveled edge 225. FIG. 25 shows an example of the flooring system 200 that includes a step transition feature, such as the ramp feature 221 shown in FIG. 23A.

Referring now to FIG. 26 and FIG. 27 is example configurations of the presently disclosed flooring system 200 atop the concrete surface of the standard porch structure 100 and including a minimal amount of fastening. Namely, FIG. 26 shows an example of the flooring system 200 formed using the arrangement 400 shown in FIG. 18A. FIG. 27 shows an example of the flooring system 200 formed using the arrangement 400 shown in FIG. 18B.

Optionally, a buffer layer can be provided between the concrete surface and the flooring system 200. For example, FIG. 28 shows an exploded view of the flooring system 200 that further includes a buffer layer 270 between, for example, the concrete floor 110 and the flooring system 200. The purpose of the buffer layer 270 is to provide a "padding" effect between possibly a rough surface of the concrete floor 110 and the underside of the flooring system 200. The buffer layer 270 can be any water resistant and durable material, such as, but not limited to, felt roofing paper and weather barrier material, (e.g., DuPont™ Tyvek® HomeWrap®, an air and water barrier).

Referring now to FIG. 29 is a flow diagram of an example of a method 800 of installing the presently disclosed flooring system 200 directly atop a concrete surface according to a simplest configuration. A main advantage of the method 800 is that the majority of floor members can be installed without the use of tools and without mechanical fasteners installed in the concrete. The method 800 may include, but it not limited to, the following steps.

At a step 810, the floating floor members 202 and the holding floor members 204 are provided. For example and referring now to the arrangement 500 shown in FIG. 19A, multiple two-end-notched floor members 240 (i.e., the floating floor members 202) and two one-side-notched holding members 220 (i.e., the holding floor members 204) are provided. The number and length of the two-end-notched floor members 240 depends on the area to be covered. Likewise, the length of the one-side-notched holding members 220 depends on the area to be covered.

At a step 812, the floating floor members 202 are arranged on the surface to be covered, all the while using no tools or fasteners. Continuing the example of the arrangement 500 shown in FIG. 19A, the two-end-notched floor members 240 (i.e., the floating floor members 202) are arranged on the concrete floor 110, all the while using no tools or fasteners.

At a step 814, the holding floor members 204 are arranged with respect to the floating floor members 202 on the surface to be covered. Continuing the example of the arrangement 500 shown in FIG. 19A, the first one-side-notched holding member 220 (i.e., the holding floor member 204) is arranged on the concrete floor 110 with respect to one end of the two-end-notched floor members 240 (i.e., the floating floor members 202). Then, the second one-side-notched holding member 220 (i.e., the holding floor member 204) is arranged on the concrete floor 110 with respect to the other end of the two-end-notched floor members 240 (i.e., the floating floor members 202).

At a step 816, the holding floor members 204 are secured to the surface to be covered. Continuing the example of the arrangement 500 shown in FIG. 19A, the first one-side-notched holding member 220 (i.e., the holding floor member 204) is secured to the concrete floor 110 using, for example, adhesive 250 or as few as two mechanical fasteners 252. Then, the second one-side-notched holding member 220 (i.e., the holding floor member 204) is secured to the concrete floor 110 using, for example, adhesive 250 or as few as two mechanical fasteners 252.

At an optional step 818, one or more floating floor members 202 are secured to the surface to be covered. Continuing the example of the arrangement 500 shown in FIG. 19A, the two outermost two-end-notched floor members 240 (i.e., now becoming holding floor member 204) are secured to the concrete floor 110 using, for example, adhesive 250 or as few as two mechanical fasteners 252 each.

Referring now to FIG. 30 is a perspective view of the presently disclosed flooring system 200 in combination with other standard construction members. For example, the standard porch structure 100 may a screened in porch that includes a wood frame structure 150. The wood frame structure 150 includes horizontal framing members 152 (aka top plates or sole plates, i.e., 2×4 s) as well as multiple vertical framing members 154 (e.g., wall studs, i.e., 2×4 s) attached to the horizontal framing members 152. In this example, a notch 153 may be provided in the lower edge of one or more horizontal framing members 152 for receiving, for example, the un-notched ends 214 of the one-end-notched floor members 210. In one example, the height h of the notch 153 can be about equal to the thickness t of the one-end-notched floor members 210 and the depth d of the notch 153 can be about 0.5 inches or about 1 inch.

FIG. 31 and FIG. 32 show yet other configurations of the presently disclosed flooring system 200 installed directly atop a concrete surface while using minimal fasteners. Namely, FIG. 31 shows an arrangement 900 of floor members 280, which can be, for example, standard composite decking boards with no modifications (e.g., no notches) that are attached directly atop the concrete floor 110 using adhesive 250 and/or mechanical fasteners 252. Accordingly, in the configuration shown in arrangement 900 of FIG. 31, all flooring members are holding floor members, albeit sill with a minimal number of mechanical fasteners 252. FIG. 32 shows an arrangement 1000 of two-side-notched holding members 230 arranged side-by-side in alternating fashion. In the arrangement 1000, every other two-side-notched holding member 230 is attached and every other two-side-notched holding member 230 is floating. The two-side-notched holding members 230 can be bounded on each side by, for example, a one-side-notched holding member 220.

The notches in the floating floor members 202 (e.g., one-side-notched holding members 220 and the two-side-notched holding members 230) and in the holding floor members 204 (e.g., the one-end-notched floor members 210 and the two-end-notched floor members 240) provide a means for holding or interlocking the floor members together directly atop a concrete surface that is substantially hidden from view. However, the presently disclosed flooring system 200 is not limited to notches for holding or interlocking the floor members together directly atop a concrete surface in a way that is substantially hidden from view. Any other type of substantially hidden holding or interlocking means can be used in the presently disclosed flooring system 200. For example and referring now to FIG. 33, the presently disclosed flooring system 200 includes peg and hole joints 290 for interlocking the ends of the floating floor members 202 to the sides of the holding floor members 204. The peg and hole joints 290 include pegs 292 that can be fitted into holes 294 in the floating floor members 202 and into holes 294 in the holding floor members 204. While FIG. 33 shows the holes 294 in one side only of the holding floor member 204, the holes 294 can be in both sides of the holding floor member 204.

Referring again to FIG. 2 through FIG. 33, the heads of the mechanical fasteners 252 can be substantially hidden or blended with the surface of the presently disclosed flooring system 200. In one example, the heads of the mechanical fasteners 252 can be substantially the same color as the flooring members of the flooring system 200. In another example, the heads of the mechanical fasteners 252 can be set slightly below floor level and capped with a camouflaging cap that substantially matches the surface texture and/or color of the flooring members of the flooring system 200.

Further, the presently disclosed flooring system 200 and method 800 provides an easily installed, long lasting, moisture-tolerant, aesthetically pleasing, and pleasant feeling floor covering for any concrete surface, such as for a concrete porch, concrete patio, and concrete floor of any building. Namely, the presently disclosed flooring system 200 and method 800 can be used to provide the look and feel of wood to a concrete surface.

Further, the presently disclosed flooring system 200 and method 800 is suitable for use atop concrete in any non-dry environments, such as any exterior environments and in basements.

Further, the presently disclosed flooring system 200 and method 800 requires about one inch only (i.e., the thickness of the floating floor members 202 and the holding floor members 204) of vertical clearance atop the concrete surface to be covered, as compared with the several inches (which is very limiting) that is needed to install a conventional sleeper system.

Further, the presently disclosed flooring system 200 and method 800 is not limited to use with concrete surfaces only. The presently disclosed flooring system 200 and method 800 can be used with any type of surface, such as, but not limited to, concrete surfaces, stone surfaces, tile surfaces, brick surfaces, composite surfaces, wood surfaces, and any combinations thereof.

Further, the presently disclosed flooring system 200 can be easily removed because of the lesser number of holding floor members 204 compared to the greater number of floating floor members 202.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A flooring system, comprising: floor members made of non-wood material, wherein the floor members comprise one or more holding floor members and two or more floating floor members, and are configurable to form a floor covering atop an installation surface, and wherein the one or more holding floor members are configurable and arrangeable to secure the floor covering in place atop the installation surface wherein the one or more holding floor members comprise a notch formed on an underside side edge thereof, the notch spanning substantially an entire length of the underside side edge, and wherein the two or more floating floor members each comprise a notch formed on an upper side of at least one end of the two or more floating floor members, the notch spanning substantially an entire width of the at least one end; and wherein when installed atop the installation surface the two or more floating floor members are arranged as adjacent parallel floor members and are in physical abutment with each other along their adjacent parallel sides and are not interconnected with one another along their adjacent parallel sides, and further the notch of the one or more holding floor members overlap with the notch of the two or more floating floor members to hold the two or more floating floor members in place atop the installation surface.

2. The flooring system of claim 1, wherein the installation surface comprises a non-dry environment.

3. The flooring system of claim 1, wherein one or more of the holding floor members are directly secured to the installation surface using at least one of an adhesive and mechanical fastener, and wherein the floating floor members are not directly secured to the installation surface.

4. The flooring system of claim 1, wherein one or more of the one or more holding floor members and one or more of the floating floor members are directly secured to the installation surface using at least one of an adhesive and mechanical fastener.

5. The flooring system of claim 1, wherein one or more of the one or more holding floor members engage with one or more of the floating floor members in a partially overlapping fashion.

6. The flooring system of claim 1, wherein the installation surface comprises an existing flooring surface.

7. The flooring system of claim 1, wherein the installation surface comprises any one or more of a concrete surface, stone surface, tile surface, and/or brick surface.

8. The flooring system of claim 1, wherein the non-wood decking material comprises at least one of composite decking material and poly(vinyl chloride) (PVC) decking material.

9. The flooring system of claim 1, wherein one or more of the floor members are secured to the installation surface using at least one of an adhesive and mechanical fastener.

10. The flooring system of claim 9, wherein the mechanical fastener comprises at least one of a screw, bolt, and nail.

11. The flooring system of claim 1, wherein the floating floor members are secured in place atop the installation surface by a lessor number of the one or more holding floor members.

12. The flooring system of claim 1 further comprises a buffer layer disposed between the floor covering and the installation surface.

13. The flooring system of claim 1, wherein one or more of the floor members comprise one or more drainage channels along an underside thereof.

14. The flooring system of claim 1, wherein one or more of the floor members comprise a ramp feature or step transition feature on an upper surface thereof.

15. The flooring system of claim 1, further comprising a ramp strip.

16. The flooring system of claim 1, further comprising a holding strip, wherein the holding strip is secured to at least one of the installation surface and an adjacent structure.

17. The flooring system of claim 1, wherein a portion where the floating floor members overlap with the notch of the one or more holding floor members is substantially hidden from view.

18. A method of installing the flooring system atop an installation surface:

a. providing a flooring system, comprising: floor members made of non-wood material, wherein the floor members comprise one or more holding floor members and two or more floating floor members, and are configurable to form a floor covering atop an installation surface, and wherein the one or more holding floor members are configurable and arrangeable to secure the floor covering in place atop the installation surface wherein the one or more holding floor members comprise a notch formed on an underside side edge thereof, the notch spanning substantially an entire length of the underside side edge, and wherein the two or more floating floor members each comprise a notch formed on an upper side of at least one end of each of the two or more floating floor members, the notch spanning substantially an entire width of the at least one end; and wherein when installed atop the installation surface the two or more floating floor members are arranged as adjacent parallel floor members and are in physical abutment with each other along their adjacent parallel sides and are not interconnected with one another along their adjacent parallel sides, and further the notch of the one or more holding floor members overlap with the notch of the two or more floating floor members to hold the two or more floating floor members in place atop the installation surface;

b. arranging the floor members on the installation surface to group the floor members to form the floor covering configuration; and c. configuring one or more of the holding floor members such that the floor covering is secured in place atop the installation surface.

19. The method of claim 18, wherein the flooring system comprises a clearance height that is substantial equal to the thickness of the one or more floor members.

20. The method of claim 18, wherein the installation surface comprises a non-dry environment.

* * * * *